US007330552B1

(12) United States Patent
LaMance

(10) Patent No.: US 7,330,552 B1
(45) Date of Patent: Feb. 12, 2008

(54) MULTIPLE POSITIONAL CHANNELS FROM A CONVENTIONAL STEREO SIGNAL PAIR

(76) Inventor: Andrew LaMance, 907 Belvoir Hills Dr., East Ridge, TN (US) 37412

( * ) Notice: Subject to any disclaimer, the term of this patent is extended or adjusted under 35 U.S.C. 154(b) by 963 days.

(21) Appl. No.: 10/742,089

(22) Filed: Dec. 19, 2003

(51) Int. Cl.
*H04R 5/00* (2006.01)

(52) U.S. Cl. ..... 381/18; 381/17; 381/19; 381/306; 381/307; 381/310; 381/21; 381/22; 381/23

(58) Field of Classification Search ..... 381/17–19, 381/303, 306–307, 310, 21–23
See application file for complete search history.

(56) References Cited

U.S. PATENT DOCUMENTS

| | | | | |
|---|---|---|---|---|
| 3,646,574 A * | 2/1972 | Holzer | ..... | 381/27 |
| 3,835,255 A * | 9/1974 | Bauer | ..... | 381/21 |
| 6,711,266 B1 * | 3/2004 | Aylward | ..... | 381/22 |
| 6,934,395 B2 * | 8/2005 | Ito | ..... | 381/23 |

* cited by examiner

*Primary Examiner*—Vivian Chin
*Assistant Examiner*—Disler Paul
(74) *Attorney, Agent, or Firm*—Miller & Martin PLLC

(57) ABSTRACT

A method and system accept left and right channel inputs of audio data and provide output audio data for at least three channels in a fashion that may effect a facsimile of the original soundstage on which the left and right inputs were recorded.

20 Claims, 36 Drawing Sheets

Functional Block Diagram of the Channel Separation Process

The trigonometric functions Sine and Cosine employed as Pan-Pot equations

Functional Block Diagram of the Channel Separation Process

Derivation of the Center Channel

Derivation of the Left-Center Channel

Derivation of the Right-Center Channel

A Derivation of the Left Channel

A Derivation of the Right Channel

Uncorrected Output vs Position Angle for all Output channels

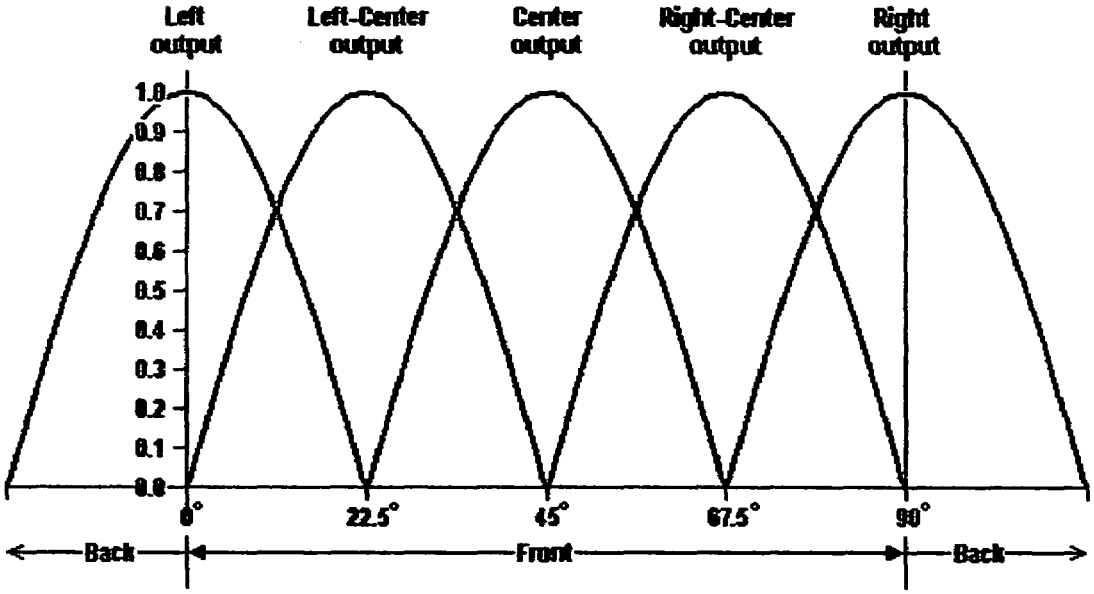
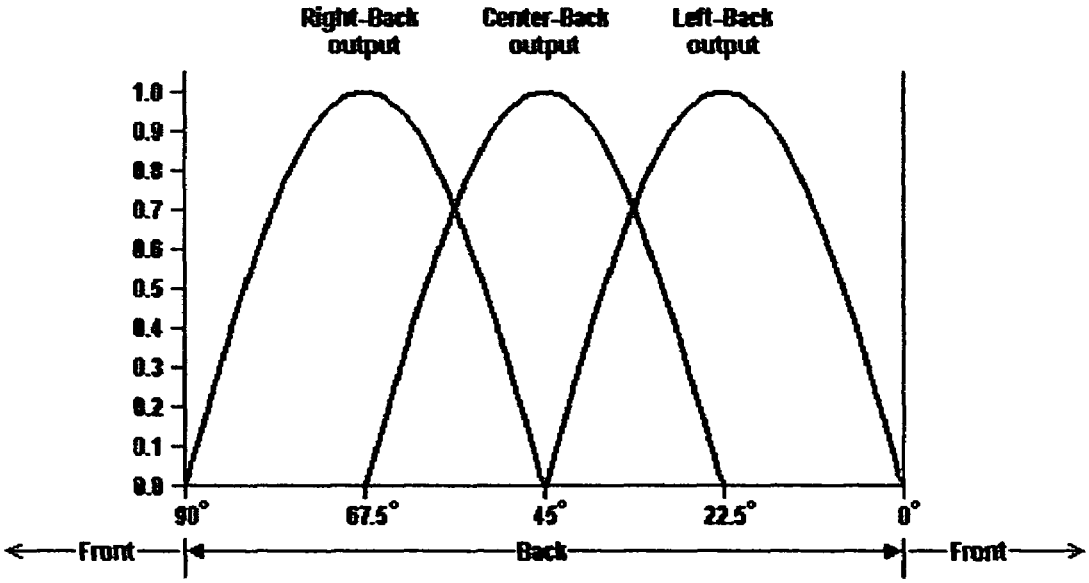
fig. 9
Ideal Output vs Position Angle
for all output channels

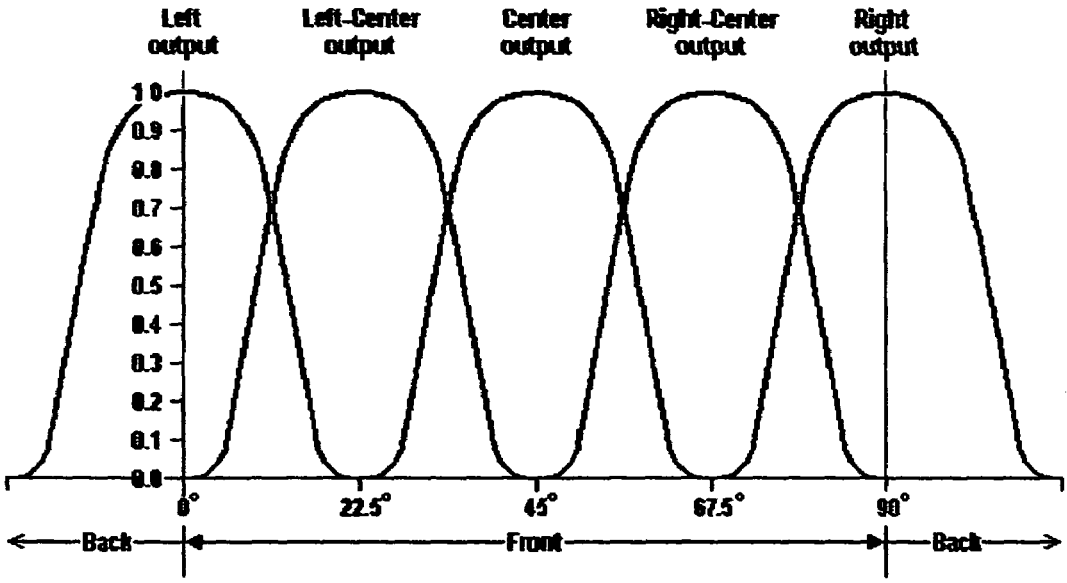
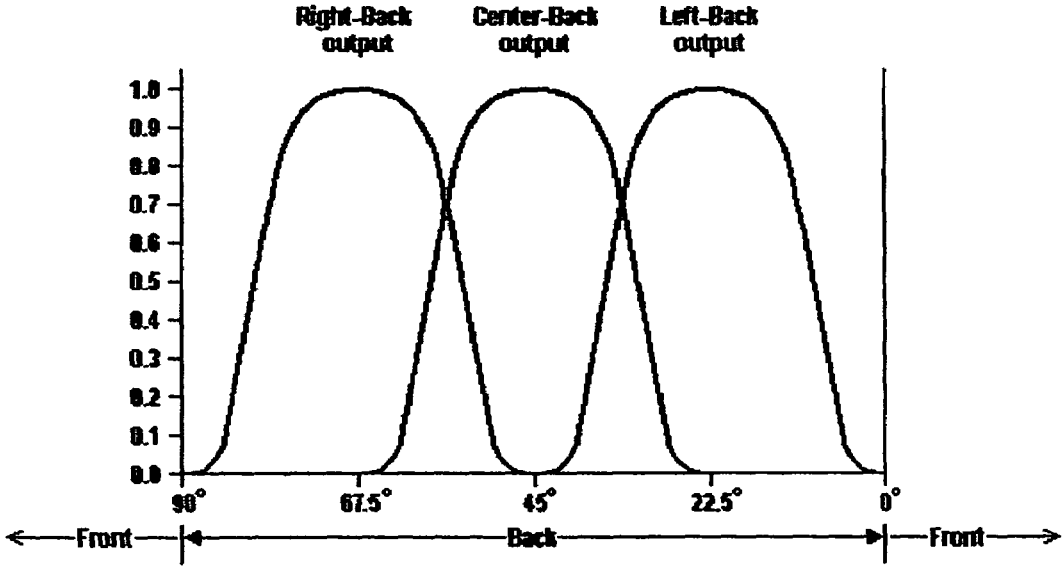
fig. 10
Output vs Position Angle for all output channels depicting small inter-channel gaps

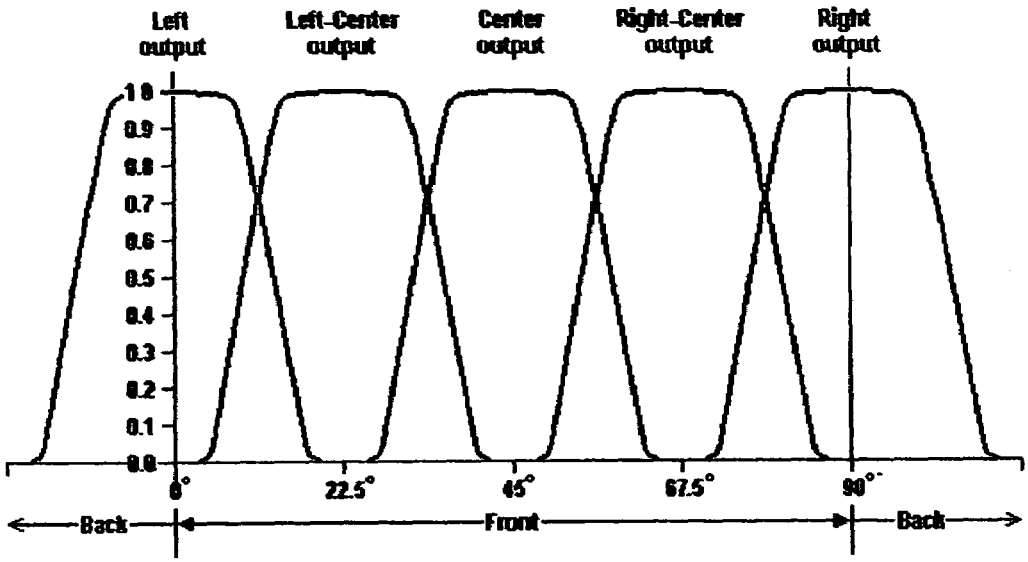
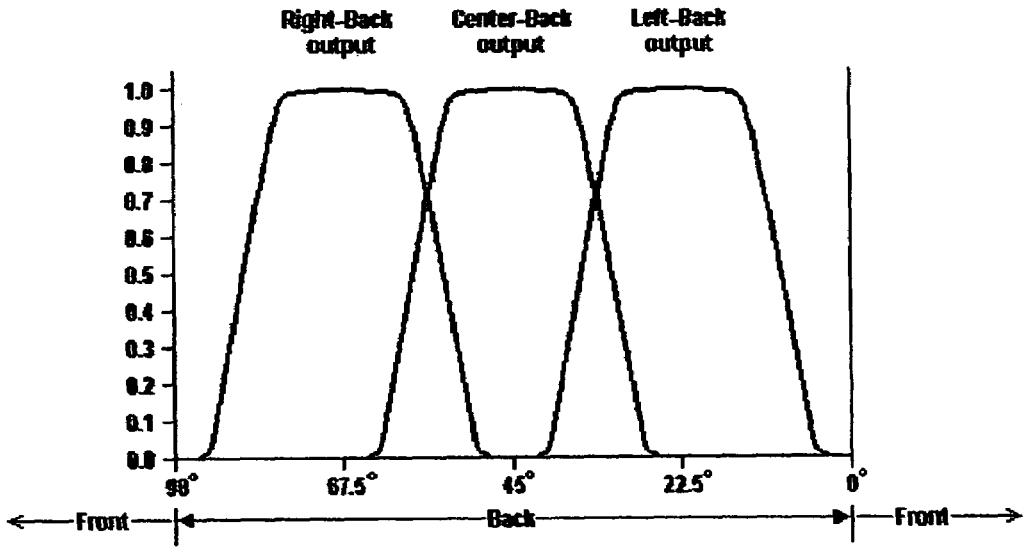
fig.11
Output vs Position Angle for all output channels depicting moderate inter-channel gaps

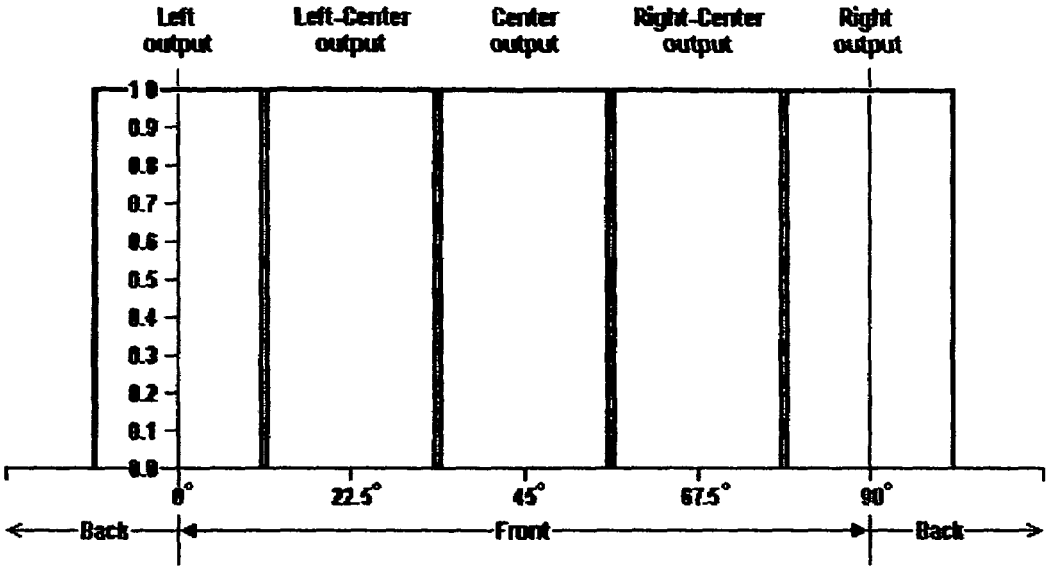
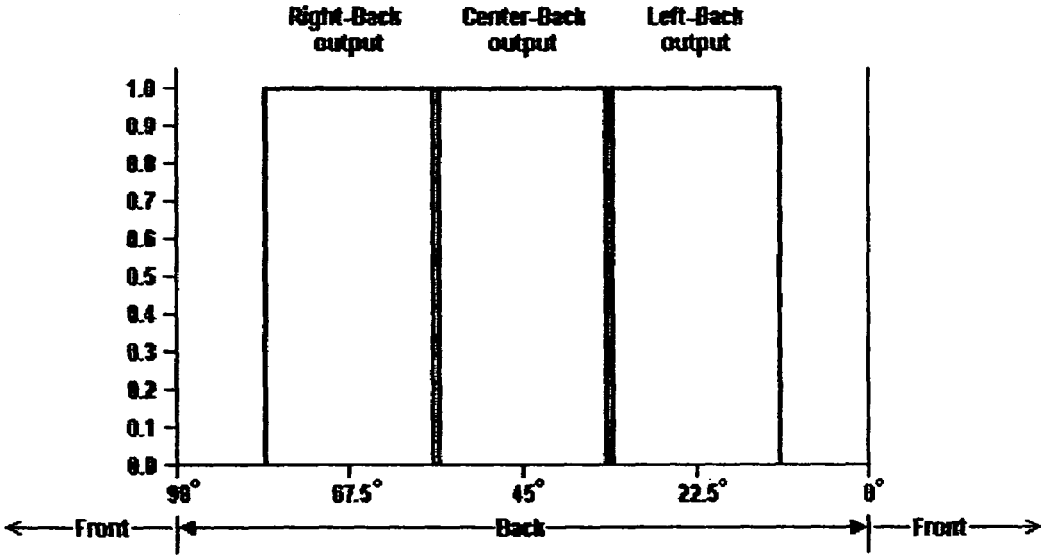
fig. 12
Output vs Position Angle for all output channels depicting inter-channel gaps just wide enough to preclude adjacent channel overlap

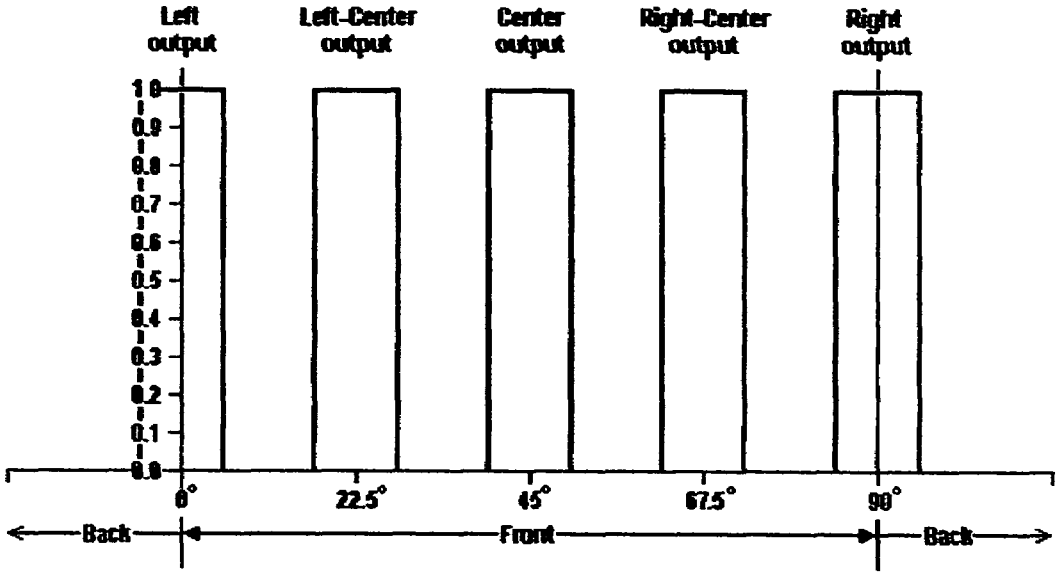
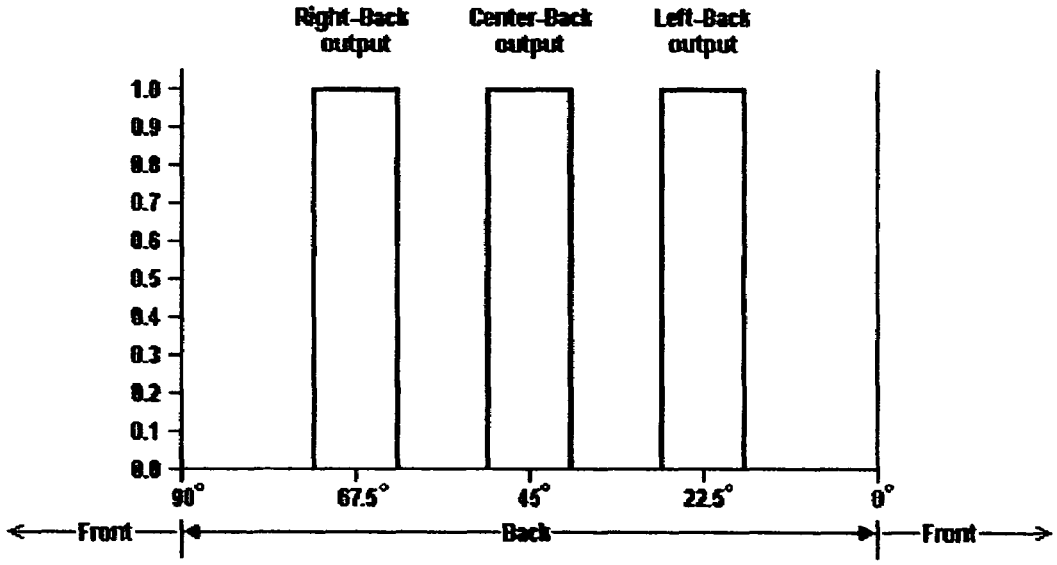
fig. 13
Output vs Position Angle for all output channels depicting wide inter-channel gaps

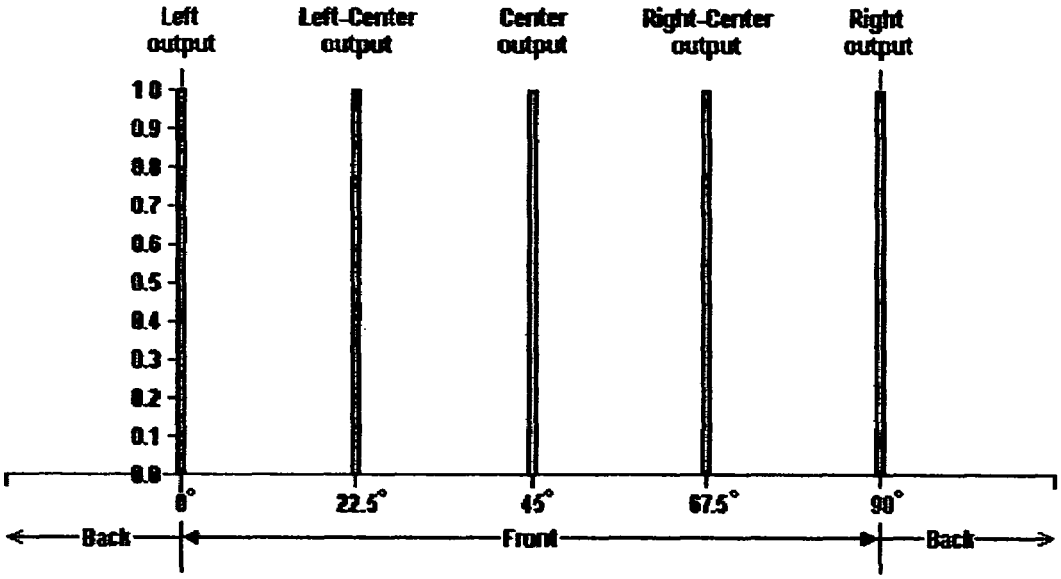
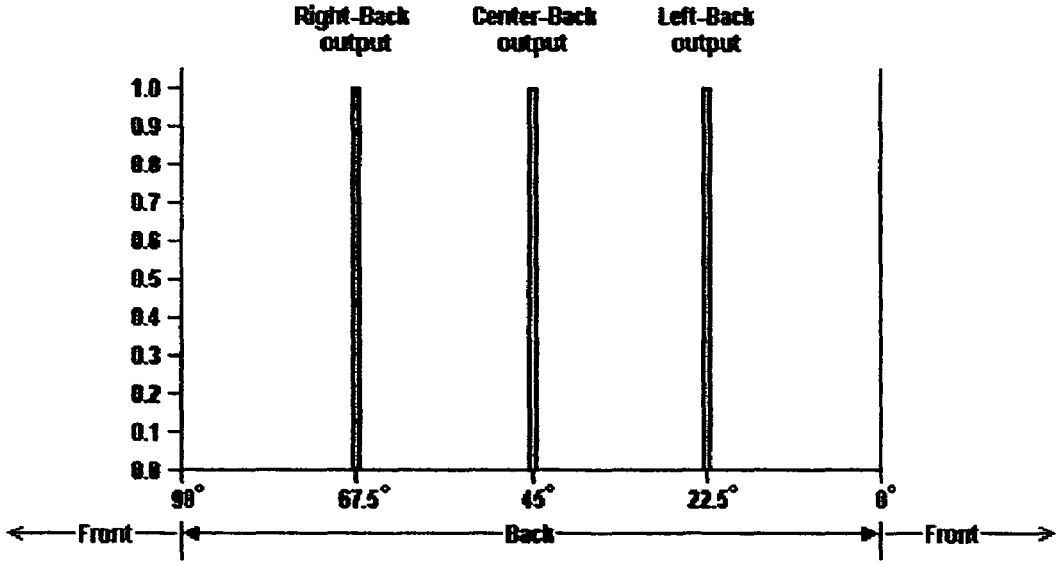
fig. 14
Output vs Position Angle for all channel with inter-channel gaps at maximum width Loudspeaker Placement dictated by the theoretical model upon which the Channel Separation Process is based Loudspeaker Placement for practical implementation of the Channel Separation Process Desired Channel Output vs Position Angle
for all channels in the Dolby 5.1 emulation Functional Block Diagram of the Channel Separation Process for generating positional channels compatible with Dolby 5.1 type playback stsyems Derivation of the Left output channel in the Dolby 5.1 emulation Derivation of the Right output channel in the Dolby 5.1 emulation Derivation of the Center output channel in the Dolby 5.1 emulation

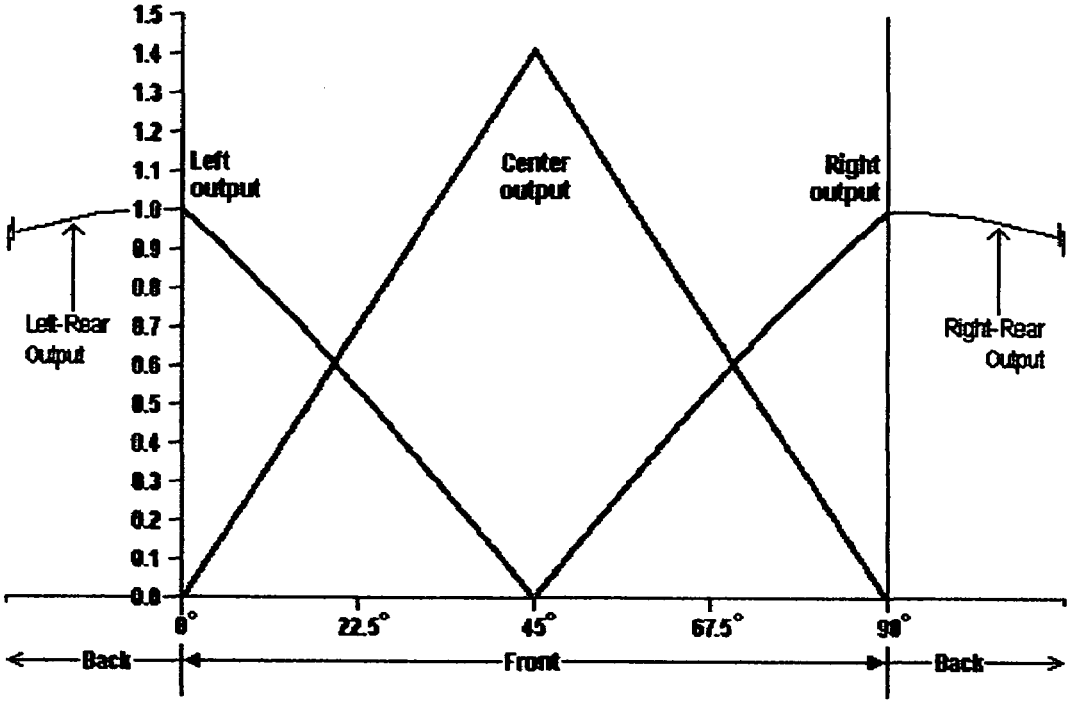
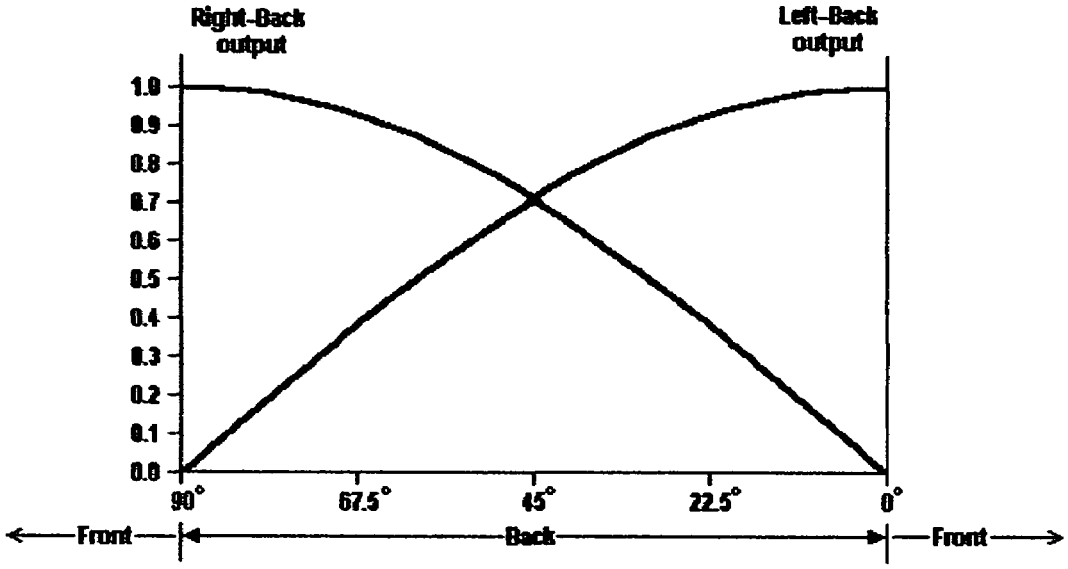
fig. 22
Uncorrected Channel Output vs Position Angle for all channels in the Dolby 5.1 emulation Loudspeaker Placement for Dolby 5.1 audio systems Functional Block Diagram of the Channel Separation Process for generating four positional output channels

Channel Output vs Position Angle for all channels in the 4 channel generation process

Loudspeaker Placement for 4 channel playback systems

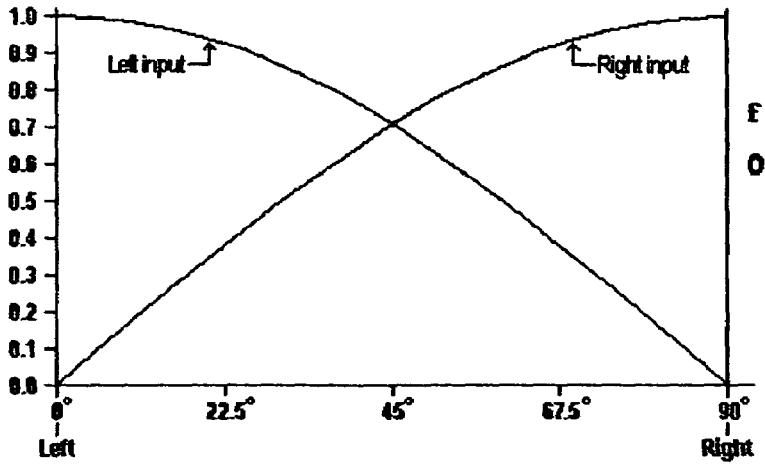
fig. 27a
Original
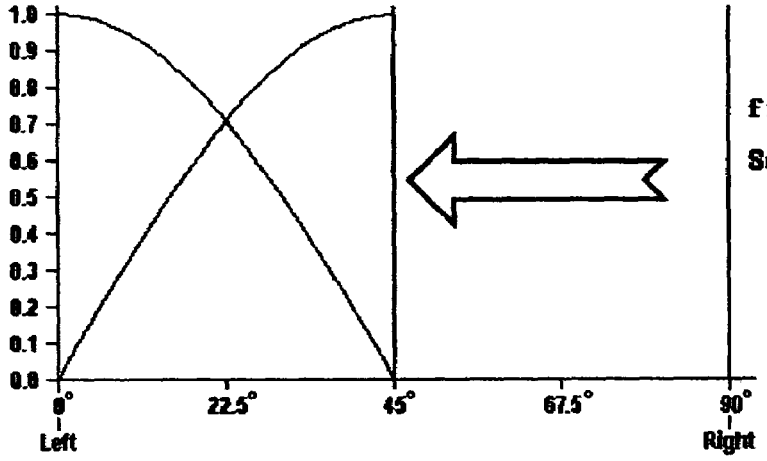
fig. 27b
Squeezed
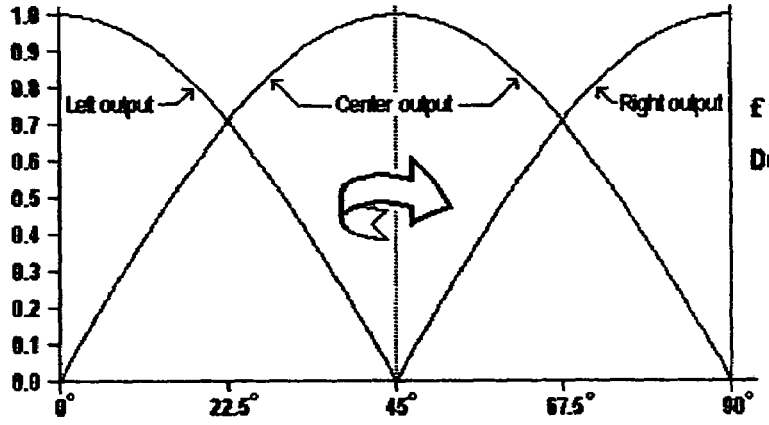
fig. 27c
Duplicated
fig. 27
Steps involved in deriving desired Output vs Position characteristics for intermediate positional channels from the original pan-pot equations Generation of One Output Channel centered between Two Input Channels.

Let P = Position Angle of the phantom image whose magnitude is to be corrected
Let L = Left pan-pot equation evaluated at position P
Let R = Right pan-pot equation evaluated at position P
Let A = the desired output magnitude at position P
Let C = the correction factor at position P
Let $X = L + R - |L - R|$
If $X > 0$ Then Let $C = A/X$ Otherwise Let $C = 0$

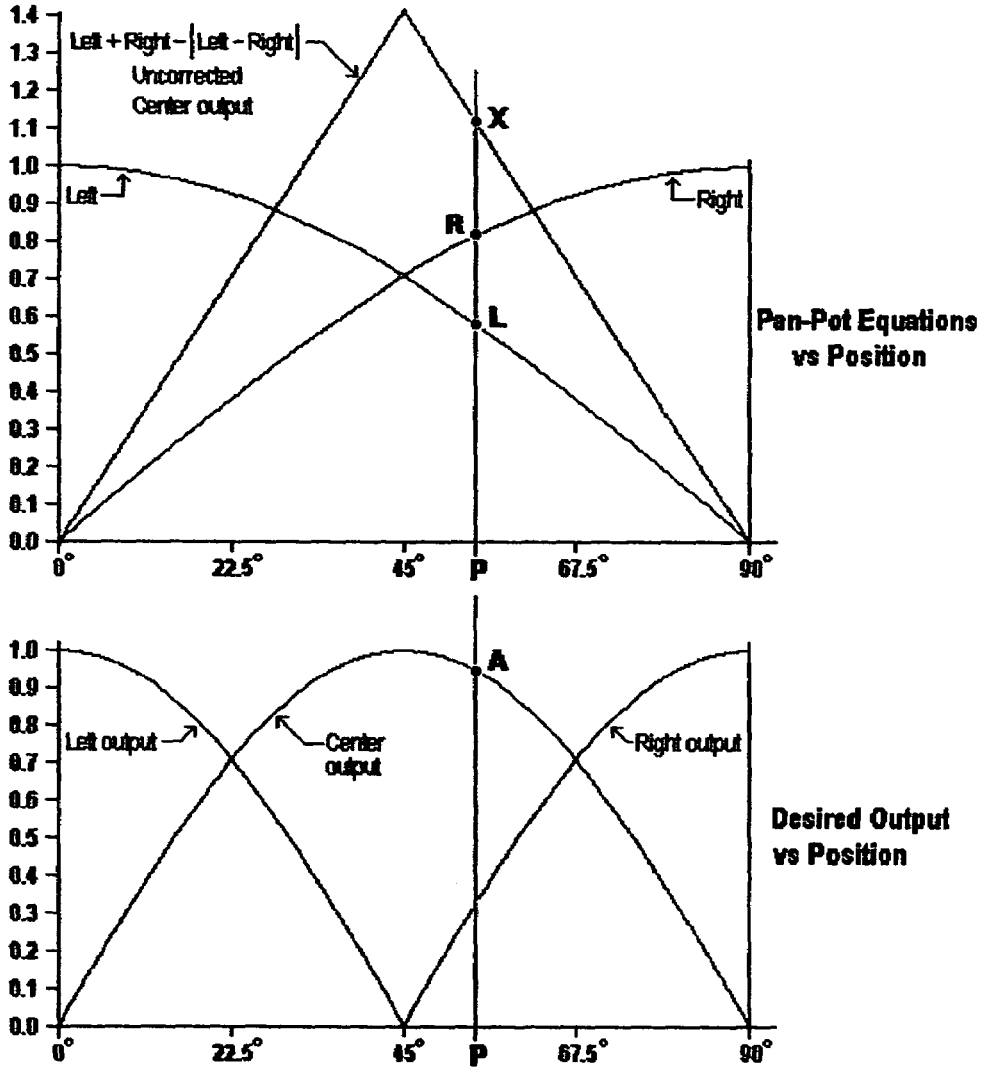

fig. 29

Dertemination of the Correction Factor
for the Center output channel

Let P = Position Angle of the phantom image whose magnitude is to be corrected
Let L = Left pan-pot equation evaluated at position P
Let R = Right pan-pot equation evaluated at position P
Let A = the desired output magnitude at position P
Let C = the correction factor at position P
Let X = L − R
If X > 0 Then Let C = A/X  Otherwise Let C = 0

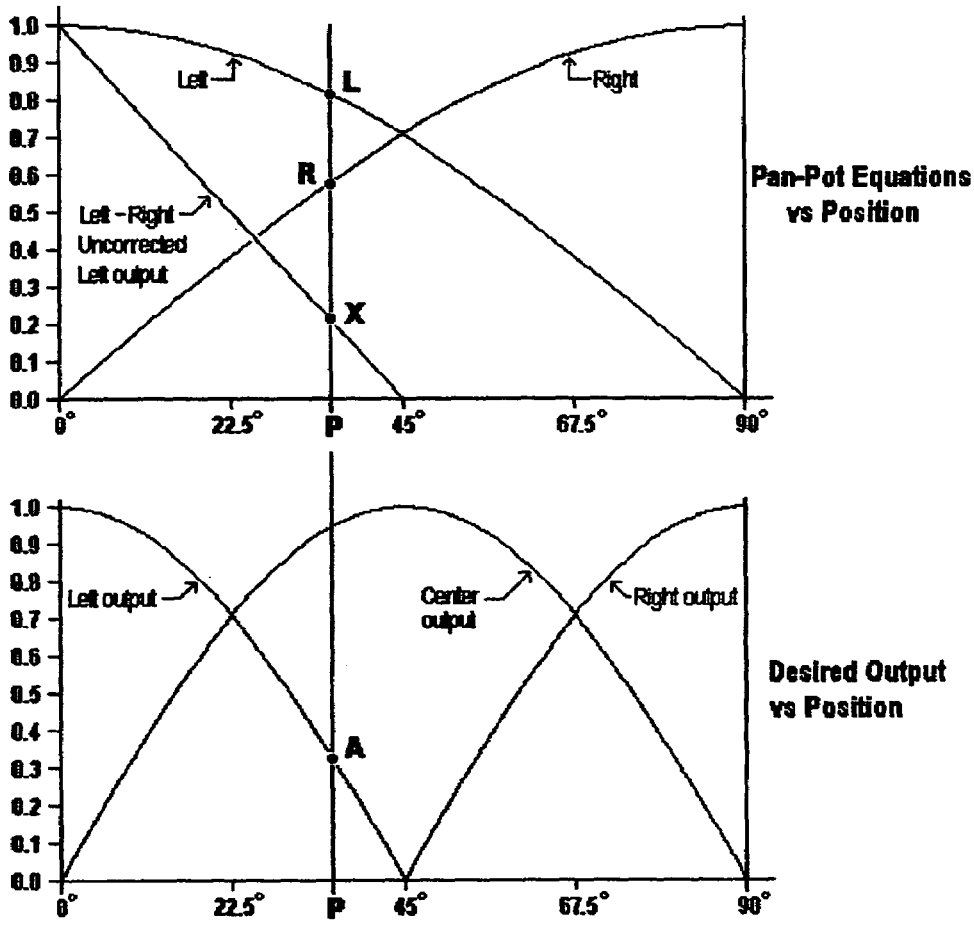

fig. 30

Dertemination of the Correction Factor
for the Left output channel

Let P = Position Angle of the phantom image whose magnitude is to be corrected
Let L = Left pan-pot equation evaluated at position P
Let R = Right pan-pot equation evaluated at position P
Let A = the desired output magnitude at position P
Let C = the correction factor at position P
Let X = R − L
If X > 0 Then Let C = A/X  Otherwise Let C = 0

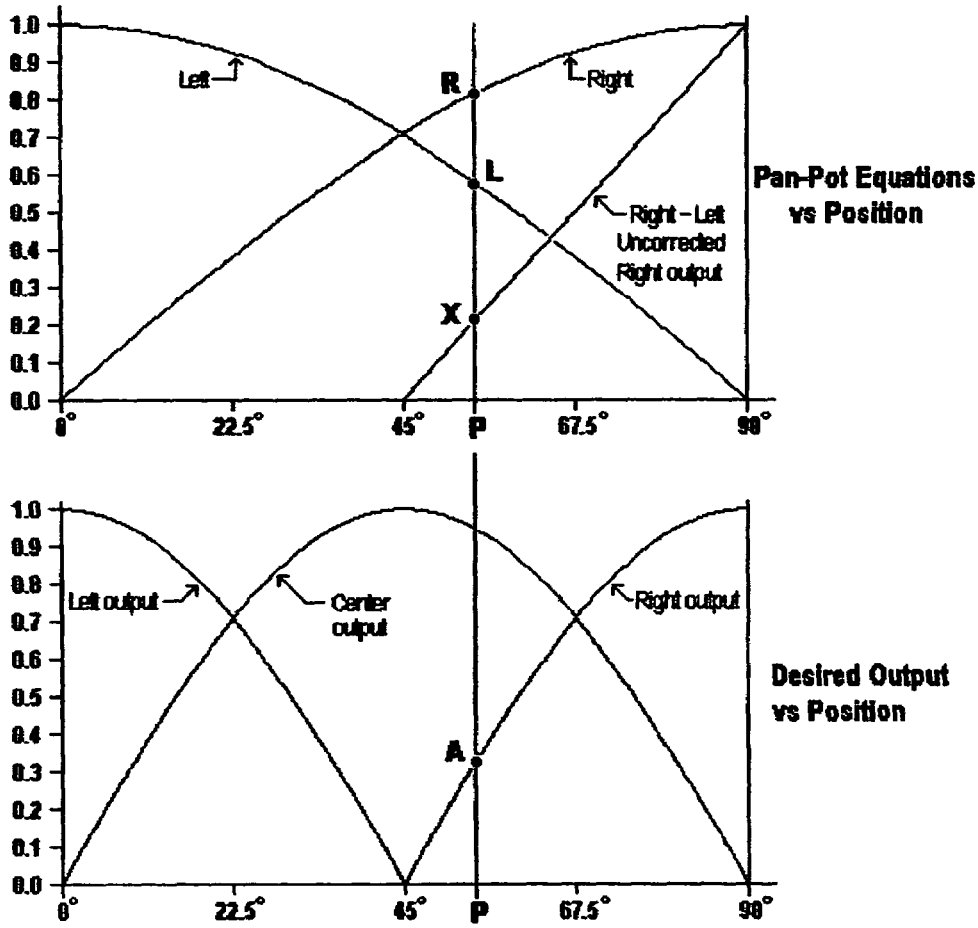

fig. 31

Dertemination of the Correction Factor
for the Right output channel

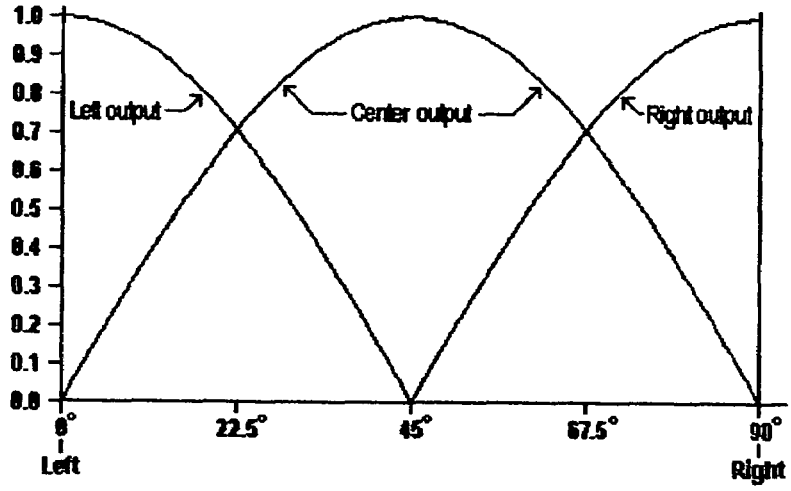
fig. 32a
1st iteration
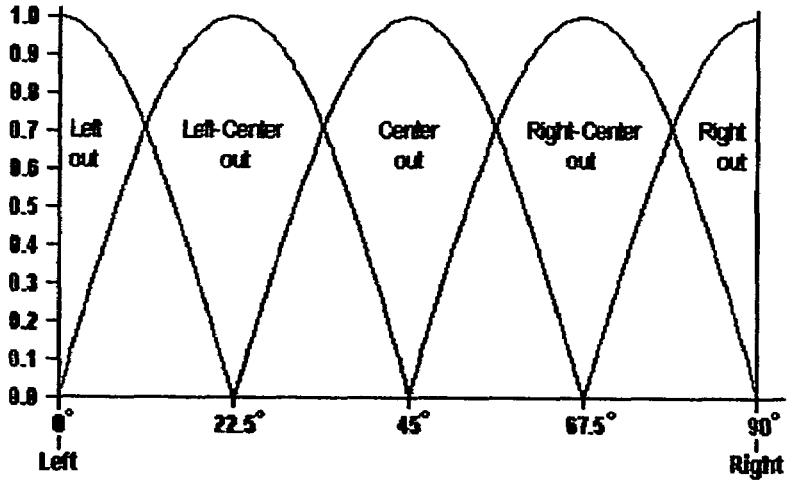
fig. 32b
2nd iteration
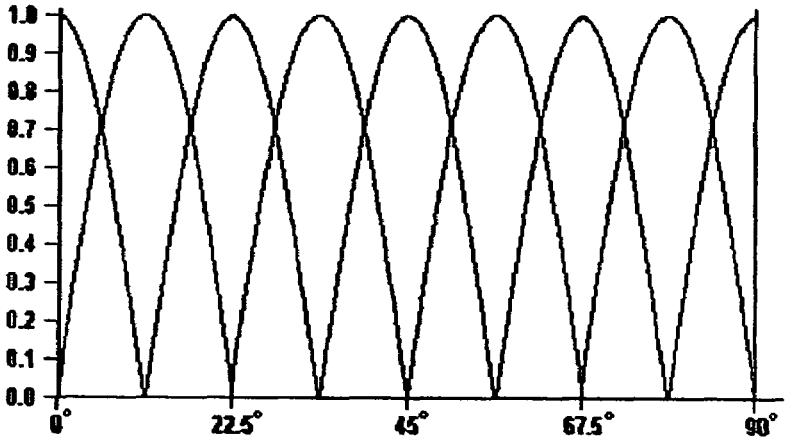
fig. 32c
3rd iteration
fig. 32
Output Channel Generation through multiple iterations of the Recursive Approach

A sample calculation illustrating the determination of the decoding constants required to produce a hypothetical positional channel beginning at a Position Angle of 11°, ending at a Positional Angle of 50°, and having a maximum at a Positional Angle of 40°. Pan-pot equations are assumed to be Sine and Cosine.

H = 11
A = 40
Q = 50

Determine C
L = Cosine(40) = 0.76604
R = Sine(40) = 0.64279
C = L/R = 0.76604/0.64279
C = 1.19175

Determine B1 ( knowing C )
L = Cosine(11) = 0.98163
R = Sine(11) = 0.19081
B1 = (0.98163 + 0.19081)/ |0.98163 − 1.19175 × 0.19081|
= 1.17244/ |0.98163 − 0.22740|
= 1.17244/ |0.75423|
= 1.17244/0.75423
B1 = 1.5545

Determine B2 ( knowing C )
L = Cosine(50) = 0.64279
R = Sine(50) = 0.76604
B2 = (0.64279+0.76604)/|0.64279 − 1.19175 × 0.76604|
= 1.40883/|0.64279 − 0.91293|
= 1.40883/|−0.27014|
= 1.40883/0.27014
B2 = 5.21518

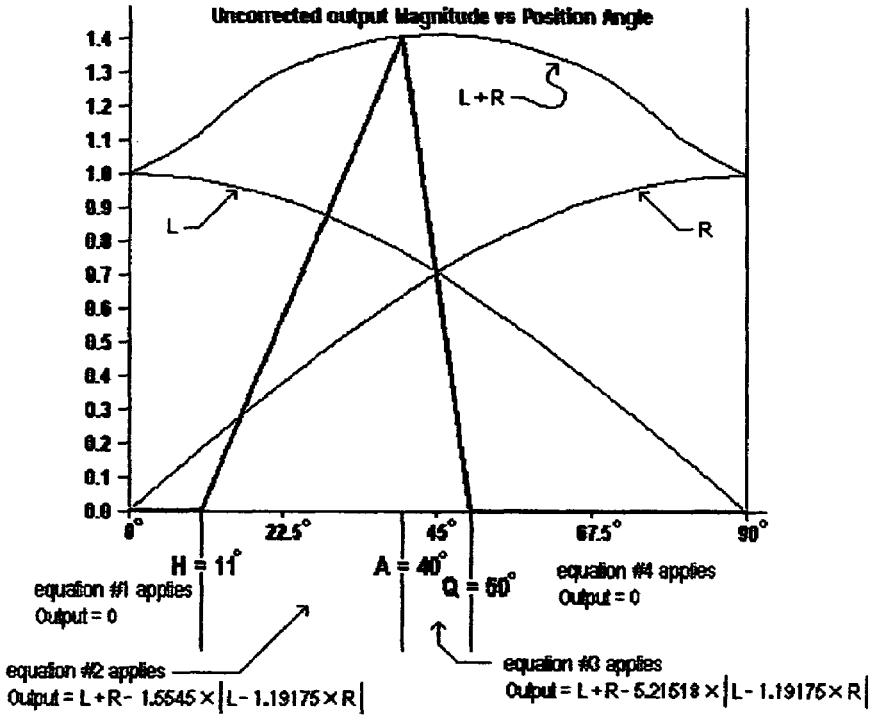

fig. 33

Sample Calculation of a hypothetical positional channel

Channel Separation Device Connection Diagram

Channel Separation Device Connection Diagram for Dolby 5.1

MULTIPLE POSITIONAL CHANNELS FROM A CONVENTIONAL STEREO SIGNAL PAIR

FIELD OF THE INVENTION

The present invention relates to the manipulation of data streams, and most particularly to the processing of digitized audio files or data streams to create data for separate output channels. The process may be employed, for instance, to process a conventional stereo audio file and create separate output not for the two (left and right) stereo output channels, but for three or more output channels while still rendering an accurate reproduction of the soundstage reflected by the conventional stereo data. In short, the current invention employs a computational process to convert a pair of electrical signals, which may be in the form of a stereo audio signal, into three or more electrical signals.

BACKGROUND OF THE INVENTION

A stereo audio recording provides the ability to place apparent sources of sound on the listener's left, right, or anywhere in between, but only the extreme left or right positions are "pure". Sounds that appear to come from a location between the left and right speakers are actually reproduced in varying proportion by both speakers resulting in a "phantom image." Since the introduction of stereo recording, audio enthusiasts have sought to enhance the listening experience by adding more positional channels, usually a front-center and one or more positions behind the listener. While innumerable attempts have been made toward this end, none have successfully isolated apparent sound sources. Movie theaters and home theaters now often employ four or five channel audio. When provided with multi-channel inputs appropriate to their design, these multi-channel audio systems can recreate a soundstage with great accuracy. However, multi-channel systems are not fully utilized when provided with only conventional stereo input. It is desirable to provide a method of processing the left and right channels of a stereo recording to be able to create electrical signals for three or more channels and more effectively utilize the capabilities of multi-channel audio systems.

In the late 1960's and early 1970's visual display devices ("color organs") were popular. Color organs are commonly driven from the same signal source as the loudspeakers. The devices were connected to the left and right speakers and displayed colored light patterns corresponding to the audio signal being fed to the speakers. Such a connection often leads to incongruous audio-visual presentations. In the simplest and most glaring case, the two loudspeakers in a stereo system are fed by in-phase signals of equal amplitude. The resulting sound appears to be originating from a point in space midway between the two loudspeakers, but the color organs produce a display on the extreme left and extreme right. There is no display in the center where the sound is, and there is no sound on the left and right where the displays are.

Ideally, the visual display should occur where the sound appears to originate. In the foregoing example, the display would appear at a point midway between the speakers and no display would appear on the left or right. More generally, as a sound appears to move from one side of the stereo soundstage to the other (left-to-right or right-to-left), the visual display should move accordingly.

A method is needed to generate a display that coincides with the apparent source of sound. Several methods such as rapidly moving a (possibly multi-colored) laser beam or generating an image for display on a cathode ray tube, for example, are possible. The method of the current invention employs a plurality of individual display devices arrayed across the area encompassed by the left and right loudspeakers. Each of the display devices is provided with its own input. The current invention can generate these inputs from the signals comprising the left and right stereo channels.

In addition, the current invention is more than simply a device to drive a visual display; it is also a multi-channel from two-channel audio playback device, as the inputs for an array of color organs can be used to generate an array of audio channels to be played over a group of loudspeakers.

It is therefore an object of the invention to apply a process to a pair of stereo audio-frequency input signals to produce at least three and preferably about eight audio-frequency output signals representing the left, left-center, center, right-center, and right positions in the input stereo soundstage (in front of a listener) and three positional channels behind the listener (right-back, center-back, and left-back).

It is a further object of the invention that each of the output channels of the current invention be made to be discrete. That is, a signal appearing in one output channel appears in at most one adjacent output channel. Having a signal in two adjacent channels is necessary to allow the formation of phantom images between the said two adjacent output channels. All other channels have no output of that signal. If the position of the phantom image in the input stereo soundfield is coincident with one of the output channels, then only that channel produces an output signal. All other channels produce no output of that signal.

It is yet another object of the invention that the rear channels be utilized in ambience recovery, but unlike prior-art systems with similar purpose, the rear channels are correlated and directional, and are thus fully capable of forming phantom images. In this fashion, it is possible to produce a stereo (two channel) recording wherein a sound source appears to be coming from a particular position behind the listener as the sound from the rear channels is not diffuse.

It is still another object of the invention that in addition to audio-frequency output signals, the current invention provides a plurality of output signals dedicated to the generation of a visual display; a "Color Organ." Each of the front output channels may have a corresponding color organ output. Optionally, an odd number (1, 3, 5, 7, . . . ) of color organ outputs may be generated between adjacent audio-output channels. By design, the process does not produce color organ outputs corresponding to the rear channels. This is not a limitation of the method. If rear color organ outputs are desired in a particular embodiment of this invention, they may be generated in the same manner as the front color organ outputs. Conventional color organs may be fed from the audio-frequency outputs, or a novel color organ developed to employ these outputs Fulfilling these objectives of the invention is not trivial. Stereo recordings are routinely produced through a process known as "pan-potting" whereby the intensity of the left and right signals is varied to affect positioning of the sound anywhere between the left and right loudspeakers. By applying the mathematical inverse of the pan-potting equations, the original signal at a given position may be recovered. Unfortunately, the inverse operation is only possible at a single frequency.

The present invention circumvents this difficulty by subjecting the input signals to a Fast Fourier Transform (FFT) which, in essence, converts them to a plurality of narrow frequency bands to which the inverse pan-potting equations may be applied. The result is not exact, but if the number of frequency bands is high, their width is sufficiently narrow to produce acceptable results. This processing is computationally intensive and may be implemented by software to convert digitized stereo data streams or files into data for each of three or more audio channels. Preferably, the computational instructions can be imbedded in processors and digitized stereo data converted to three or more digitized audio output and/or color organ output channels on the fly.

The number of locations in the stereo soundfield where the inverse pan-potting equations are to be applied and the left-right position of these locations can be chosen arbitrarily. In the currently preferred embodiment, this invention employs five equally spaced front locations. Input signals that are more than 90 degrees out-of-phase are deemed to belong in the rear and are assigned to the back channels. Signals on the extreme left or right are not reassigned, thus generating three (five front minus left and right) channels in the rear. This is considered adequate for most implementations, but the process is not limited to these values.

After the inverse pan-potting equations have been applied to each frequency band in the left and right FFTS, the result is the Fourier Transforms of the sound sources, if any, present at each of the chosen locations. The color organ outputs are derived directly from these Fourier Transforms because signal intensity at different frequencies is often an important parameter in color organs. The audio-frequency output is generated by taking the Inverse Fourier Transform (IFT) of each output channel.

Additional processing steps such as echo removal, signal enhancement, or gain riding may be performed prior to taking the IFT, but are not essential to the proper functioning of the invention. Further processing may also be done after the IFT is taken. The present invention provides an electronic channel separator device intended to enhance stereo audio playback by isolating apparent sound sources across the stereo sound stage and feeding these isolated sound sources to separate channels of amplification. Most of the room reverberation (echo, ambience) present in a recording appears in channels behind the listener. In addition, outputs are provided to drive a visual display ("color organ") to be placed in front of the listener. The visual display appears at the apparent location of the sound, and is not sensitive to room reverberation (It only responds to the primary elements in the recording). The channel separation device is connected between a conventional stereo audio signal source and one or more conventional audio amplifiers. If a graphic equalizer is employed in the playback system, the channel separation device should be connected between the graphic equalizer and the amplifier. No special hardware or adapter need be required, as suitable connections may be made through standard audio cables. The audio source may be any device that emits a stereo signal, such as a CD player, DVD player, mp3 player, tape player, radio tuner, computer disk drive or phonograph. The amplifier (or amplifiers) must have at least as many channels of amplification as the channel separation device produces. The channel separation device may be designed to produce any number of channels, but fewer than three channels accomplishes no purpose and more than eight channels is of little utility owing to the nature of recorded music Conventional stereo recordings rarely use more than eight stage positions. Owing to the present predominance of the Dolby AC-3 (5.1) home theater system, the channel separation device may be designed to supply audio outputs compatible with the Dolby 5.1 system, thereby facilitating continued, but enhanced, use of existing audio equipment. While the channel separation device is intended for use in private homes, it may find wide utility in public venues such as concert halls, arenas, stadiums, amphitheaters, planetariums, and museums. The ability to locate the apparent source of sound in a stereo recording is degraded when the listening space is large, as it is in public venues. The degradation increases as the size of the venue grows larger. Isolating apparent sound sources and routing them to actual sound sources (loudspeakers) greatly improves the reproduction quality. Furthermore, planetariums often include a light show based upon recorded music as part of their presentation and may utilize both audio channels and color organ channels for this purpose Movie theaters often play recorded music prior to the feature film and could benefit from the addition of a visual display component.

BRIEF DESCRIPTION OF THE DRAWINGS

The present invention may be explained with reference to the following drawings:

FIG. 9 depicts the ideal channel output versus stereo soundstage position for eight output channels.

FIG. 10 reflects channel output versus stereo soundstage position with only small inter-channel gaps.

FIG. 11 depicts the channel output versus stereo soundstage position angle as in FIG. 10, however with moderate inter-channel gaps.

FIG. 12 depicts channel output versus stereo soundstage position angle for eight channels with inter-channel gaps precluding adjacent channel overlap.

FIG. 13 depicts eight output channels versus stereo soundstage position angle with wide inter-channel gaps.

FIG. 14 depicts channel output versus stereo soundstage position angle for eight channels with inter-channel gaps at maximum width.

FIG. 22 depicts channel output versus stereo soundstage position for the five outputs generated by Dolby 5.1 emulation.

FIG. 27 graphically illustrates the derivation of channel output versus stereo soundstage position characteristics for intermediate position channels.

FIG. 29 is a graphic illustration of deriving a correction factor for a center output channel.

FIG. 30 is a graphic illustration of deriving a correction factor for a left output channel.

FIG. 31 is a graphic illustration of deriving a correction factor for a right output channel.

FIG. 32 illustrates output channel generation through three iterations of the recursive approach described below.

FIG. 33 illustrates the calculation of decoding constants for a hypothetical positional output channel.

DETAILED DESCRIPTION OF PROCESS

While a plurality of output channels may be derived by means of the current invention, the discussion herein presented assumes eight equally spaced output channels. Deriving more or fewer output channels, or deriving channels that are not equally spaced, involves changing various mathematical constants and LookUp tables used in the process, and a discussion of how these constants and tables are generated is deferred to avoid prolixity in the initial description.

The location of a phantom image (a.k.a. virtual image) in conventional (two channel) stereo recordings is achieved by varying the relative magnitude of the signals in the left and right channels according to the pan-pot (short for "panoramic potentiometer") equations. The principle characteristic of the pan-pot equations is that the sum of the squares of the left and right signals maintains a constant value as the signal is moved ("panned") from one side of the stereo soundstage to the other. This characteristic assures that the sound power remains constant when the phantom image is moved across the stereo soundstage. That is, the sound becomes neither louder nor softer as it is moved. While many equations with this characteristic may be devised, the most widely used equations are the trigonometric functions sine and cosine. It is upon these equations that the current invention is based. If other pan-pot-equations are to be employed, the process of the current invention may be easily modified to accommodate them.

Figure 1:
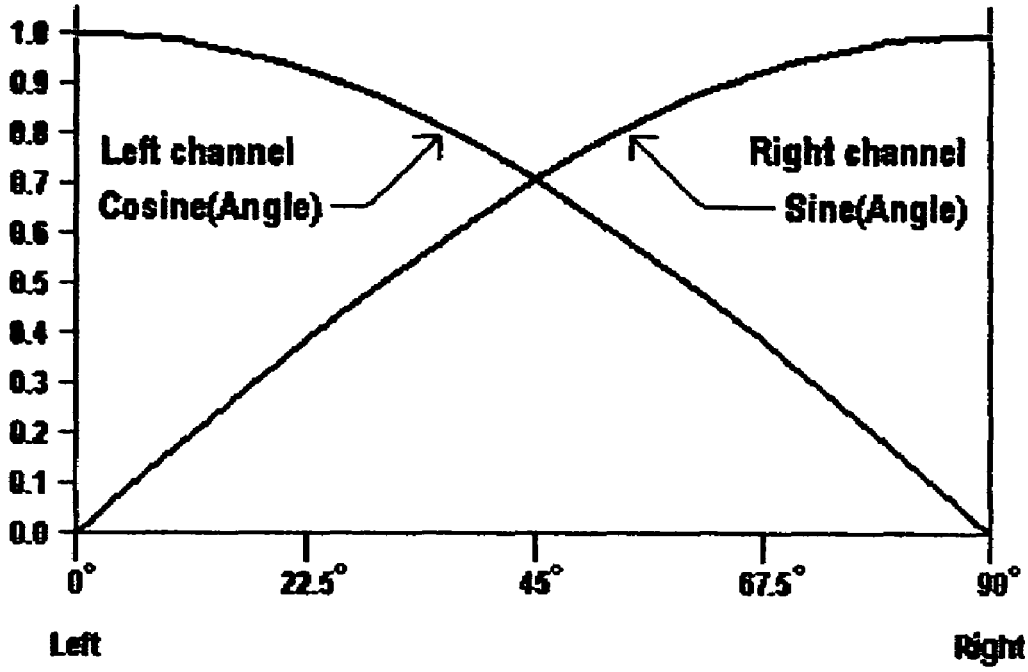
FIG. 1 is a graph depicting the sine and cosine functions employed as pan-potting equations.

FIG. 1 illustrates the sine and cosine employed as pan-potting equations. The extreme left corresponds to a positional angle of zero degrees and the extreme right corresponds to a positional angle of ninety degrees. The relative magnitude of the signal in the left channel corresponds to the cosine while the relative magnitude of the signal in the right channel corresponds to the sine. The pan-pot equations deal only with signal magnitude as a function of position expressed as an angle from zero to ninety, inclusive. The pan-pot equations do not address the relative phase of the signals and the position angles should not be assumed to have any direct relation to the relative phase of the signals.

Figure 2:
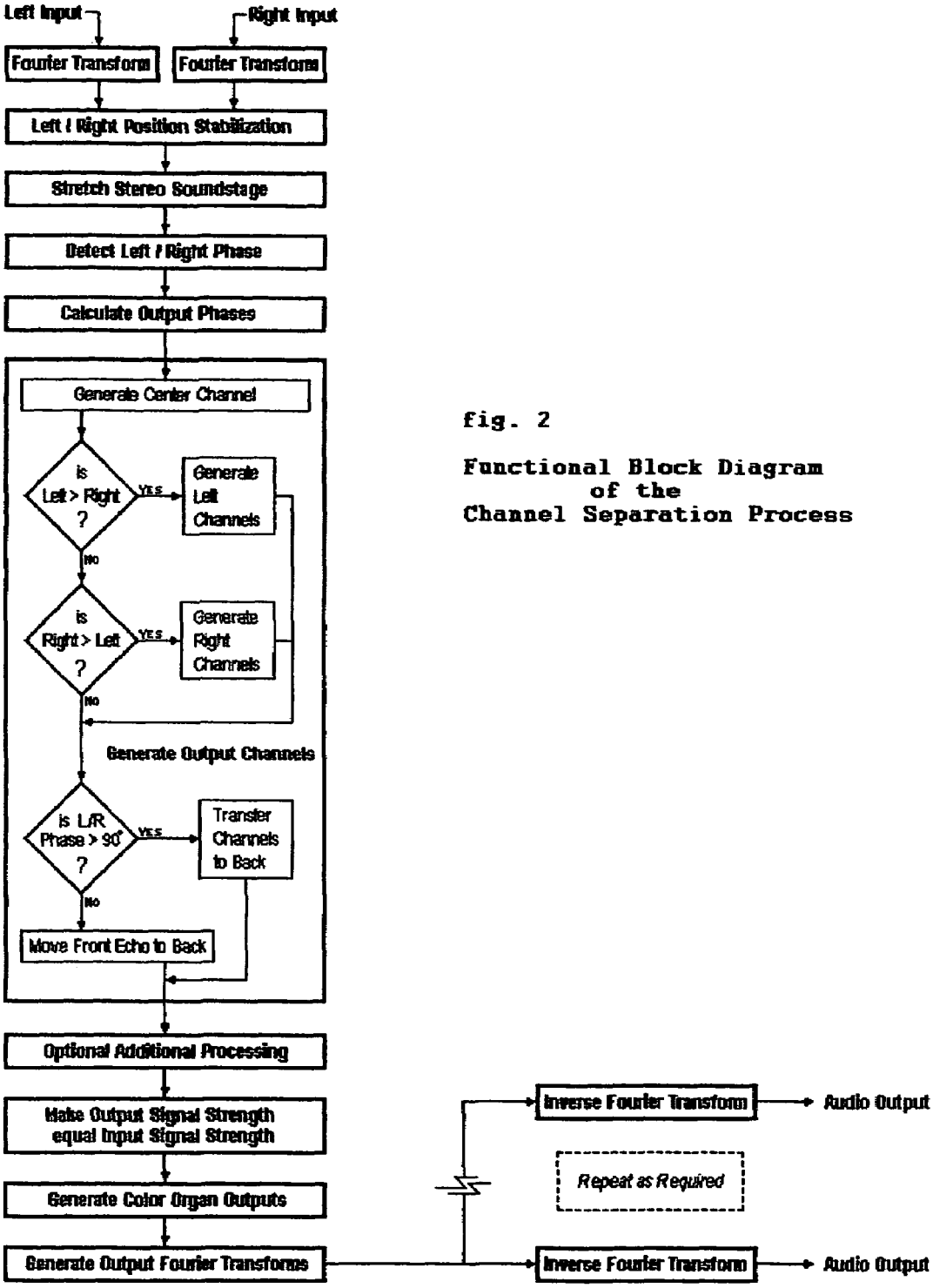
FIG. 2 is a functional block diagram of channel separation process.

FIG. 2 is a functional block diagram of the channel separation process. The order of operations illustrated is that presently employed by the current invention. The ordering may be altered at certain stages without ill effect. Because the current invention works in the frequency domain, the first operation must be that of taking the Fourier Transforms of the left and right input signals. This maps the input signals from the time domain to the frequency domain. Both of the Fourier Transforms must have the same number of frequency components at the same center frequencies.

The following steps in the current invention must be performed once for each frequency component in the Fourier Transforms of the left and right inputs. In the present discussion of the invention 2048 frequency components are designated in each Fourier Transform, but this number may be changed to increase or decrease resolution without altering the underlying process.

Left/Right Position Stabilization

Determining the position angle of the phantom image is essential to separating the two input signals into a plurality of positional output signals and is accomplished by the equivalent of taking the (trigonometric function) inverse Tangent of Right/Left. The stereo input signals often contain out-of-phase information, which leads to an incorrect position estimate. Signals whose position is incorrectly determined will appear in the wrong output channel, producing a warbling or chirping sound or "birdies". The phantom image position estimate is stabilized by setting the estimated position equal to a weighted average of the current magnitude and position estimate versus prior magnitudes and position estimates. The calculation is similar to a Moments Calculation for a mechanical lever, where the moments here are the mathematical product of the magnitude and position angle. The resulting position estimate is converted to an integer value between zero and ninety, inclusive, by rounding toward the nearest output channel's center position angle (0, 22.5, 45, 67.5, or 90 degrees from the five forward speakers in an eight channel configuration).

Stretch Stereo Soundstage

When stereo recording was novel (and again in the psychedelic 1960s), it was fashionable to utilize the full extent of stereo recording, placing sound sources in the extreme left or right positions. Contemporary fashion dictates that the extremes be avoided, producing what could be called "two-channel monophonic recordings". To compensate for recordings with diminished left/right separation, a user controlled process is implemented whereby the user may widen the stereo soundstage. The process, herein called "Stretch", relies upon a precalculated LookUp table to affect a widening of the stereo soundstage. By default, Stretch is set to ten degrees, meaning that any phantom image within ten positional degrees of extreme left or right is assigned exclusively to the left or right channel, respectively. Signals falling outside this range are relocated to fill the resulting positional gap. Signals in the center of the stereo soundstage are not relocated. Signals are relocated symmetrically with respect to the center of the stereo soundstage. If a left/right input signal pair has been Stretched, the position of the phantom image must be re-stabilized. The process employed is identical to that previously discussed in the section entitled "Left/Right Position Stabilization".

Detect Left/Right Phase

If the left and right stereo input signals are in-phase, the resulting phantom image should appear in front of the listener. In a like fashion, input signals that are 180 degrees out-of-phase should appear behind the listener. Other input phase angles are not so easily categorized. The current invention assigns left and right input signals having relative phase angles from zero to ninety, inclusive, to the Front channels. Left and right input signals having relative phase angles greater than ninety degrees are assigned to the rear channels. Testing based upon the vector dot product (a.k.a. inner product) is employed to determine if the relative phase angle between the left and right inputs is greater than ninety degrees. If the relative phase angle is greater than ninety degrees, the algebraic sign of one of the input signals (the right in this discussion of the invention) is changed and a flag is set to indicate that the eventual output is to be assigned to the rear channels. Subsequently, the magnitudes of the left and right inputs are calculated. The magnitude of the (left+right) sum signal is calculated. If the sum of the left and right magnitudes is greater than the magnitude of the (left+right) sum, the input contains out-of-phase information, herein termed the uncorrelated signal. The magnitude of the uncorrelated signal is calculated by subtracting the magnitude of the (left+right) sum from the sum of the magnitudes of the left and right signals and is stored for later inclusion in the rear channel outputs. Subsequently the magnitudes of the left and right signals are reduced proportionally in sufficient degree so as to force their sum to equal the magnitude of the (left+right) sum.

Calculate Output Phases

The frequency components in a Fourier Transform consist of complex numbers (numbers composed of so-called Real and Imaginary parts). The Fourier Transforms of the output channels must also be composed of complex numbers. The pan-pot equations deal only with the magnitude (SquareRoot of the sum of the squares of the Real and Imaginary parts) of the frequency components and thus give no information as to the relative sizes of the Real and Imaginary parts. Some means must be employed to assess the relative sizes of the Real and Imaginary parts of the frequency components comprising the output Fourier Transforms. One method for accomplishing this is to assign phases to each output channel based upon an interpolation of the phases of the left and right inputs. Owing to the nature of the center-rear output channel, determination of the Real/Imaginary ratio for this channel must be accomplished by other methods as discussed later in the present document. For the purpose of calculating the Real/Imaginary ratio of the output channels, the actual left and right inputs are employed. The (left or right) input signal whose algebraic sign may have been changed as discussed in the section entitled "Detect Left/Right Phase" is not employed.

Generate Output Channels

In the present section, the term "right" refers to the input signal whose algebraic sign may have been changed as discussed in the section entitled "Detect Left/Right Phase". The output channels are produced through algebraic manipulation of the left and right input magnitudes followed by multiplication by precalculated values stored in a LookUp table.

Figure 3:
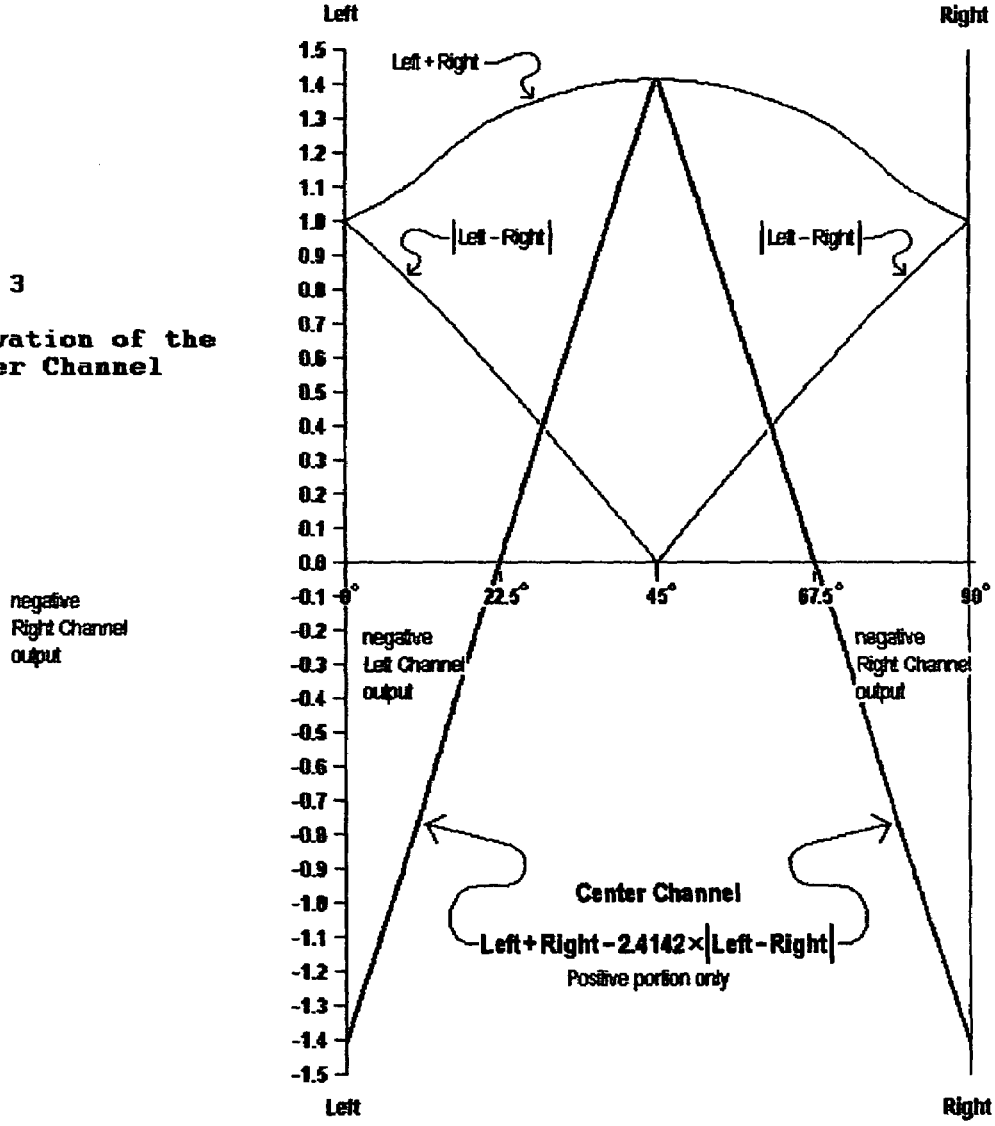
FIG. 3 illustrates graphically the derivation of the center output channel.

As shown in FIG. 3, the center output is derived by subtracting 2.4142 times the absolute value of the (left−right) difference from the (left+right) sum. The value 2.4142 is used to force the center channel to be zero at positional angles of 22.5 and 67.5 degrees and is not arbitrary: it is the tangent of 67.5 degrees. FIG. 3 is a graph illustrating the derivation of the center channel. The positive portion of the bold line constitutes the center channel output. Those portions of the bold line that are negative may be used to derive the left and right outputs, but are discarded in the embodiment under discussion.

Figure 4:
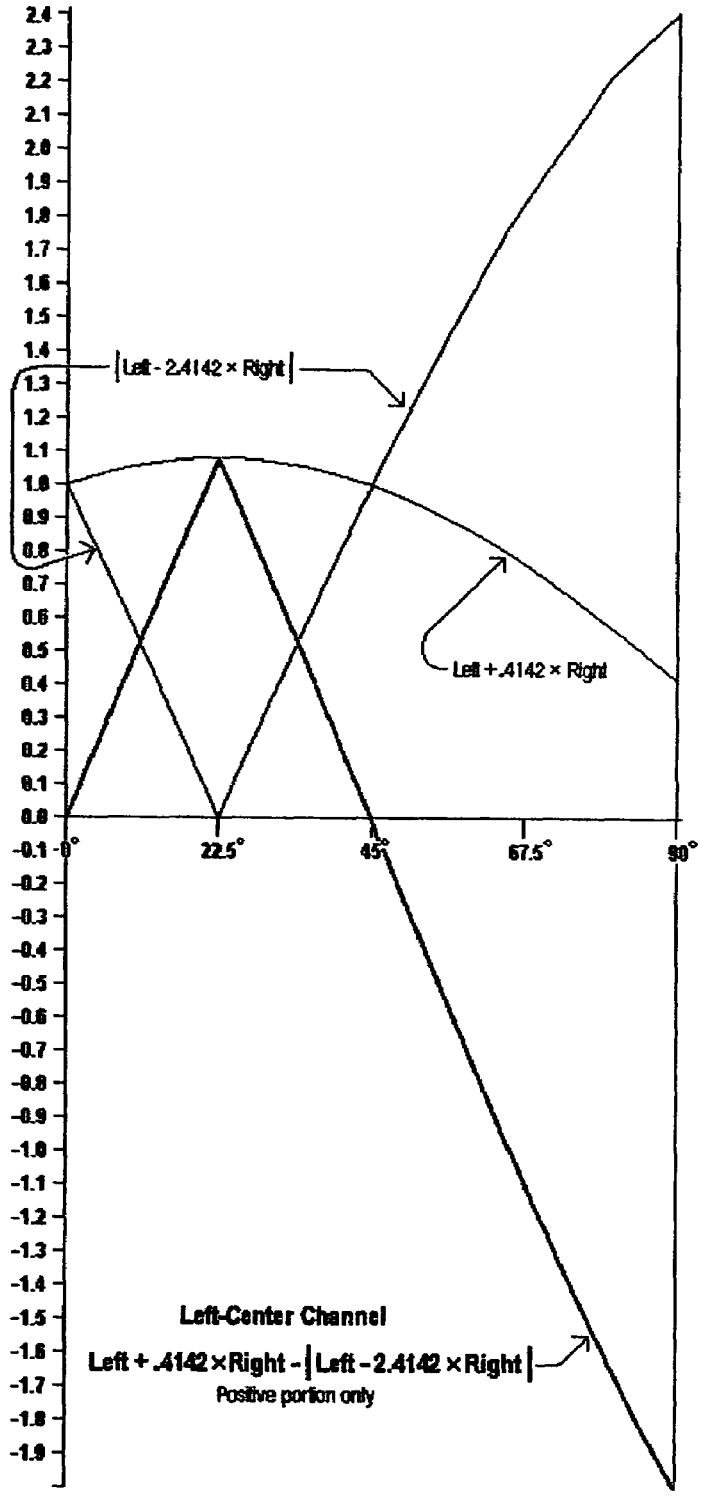
FIG. 4 graphically illustrates the derivation of the left-center output channel in an eight channel separation.

The left-center output is derived by subtracting the absolute value of the difference of the left input and 2.4142 times the right input from the sum of the left input and 0.4142 times the right input. The constants, 2.4142 and 0.4142, are chosen to force the left-center channel to be zero at positional angles of 0 and 45 degrees. The constant 2.4142 is 1 added to the square root of 2, and the constant 0.4142 is 1 subtracted from the square root of 2. FIG. 4 is a graph representing the derivation of the left-center channel. The positive portion of the bold line represents the left-center output. The negative portion is discarded.

Figure 5:
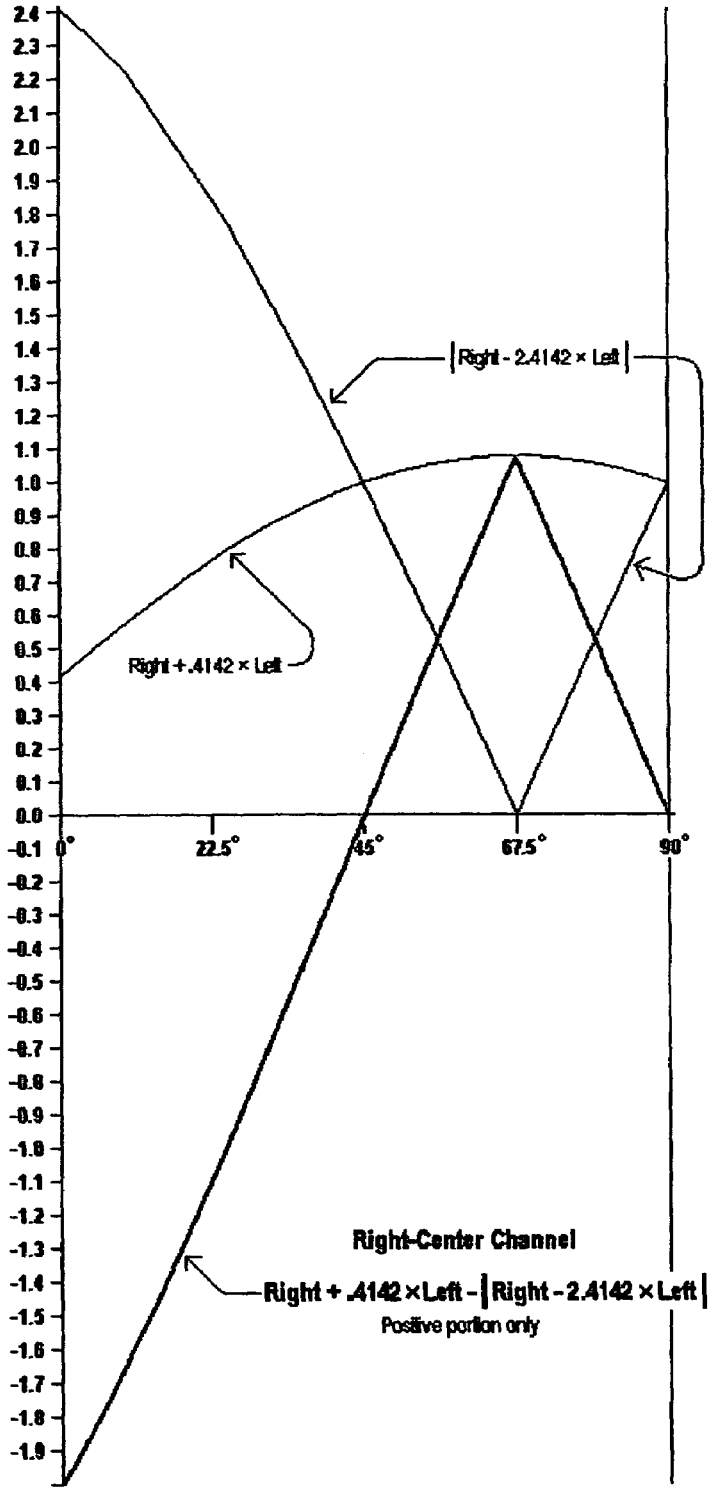
FIG. 5 illustrates the derivation of the right-center channel in an eight channel separation.

The right-center output is derived by subtracting the absolute value of the difference of the right input and 2.4142 times the left input from the sum of the right input and 0.4142 times the left input. The constants, 2.4142 and 0.4142, are chosen to force the right-center channel to be zero at positional angles of 45 and 90 degrees. The constant 2.4142 is 1 added to the square root of 2, and the constant 0.4142 is 1 subtracted from the square root of 2. FIG. 5 is a graph representing the derivation of the right-center channel. The positive portion of the bold line represents the right-center output. The negative portion is discarded.

Figure 6:
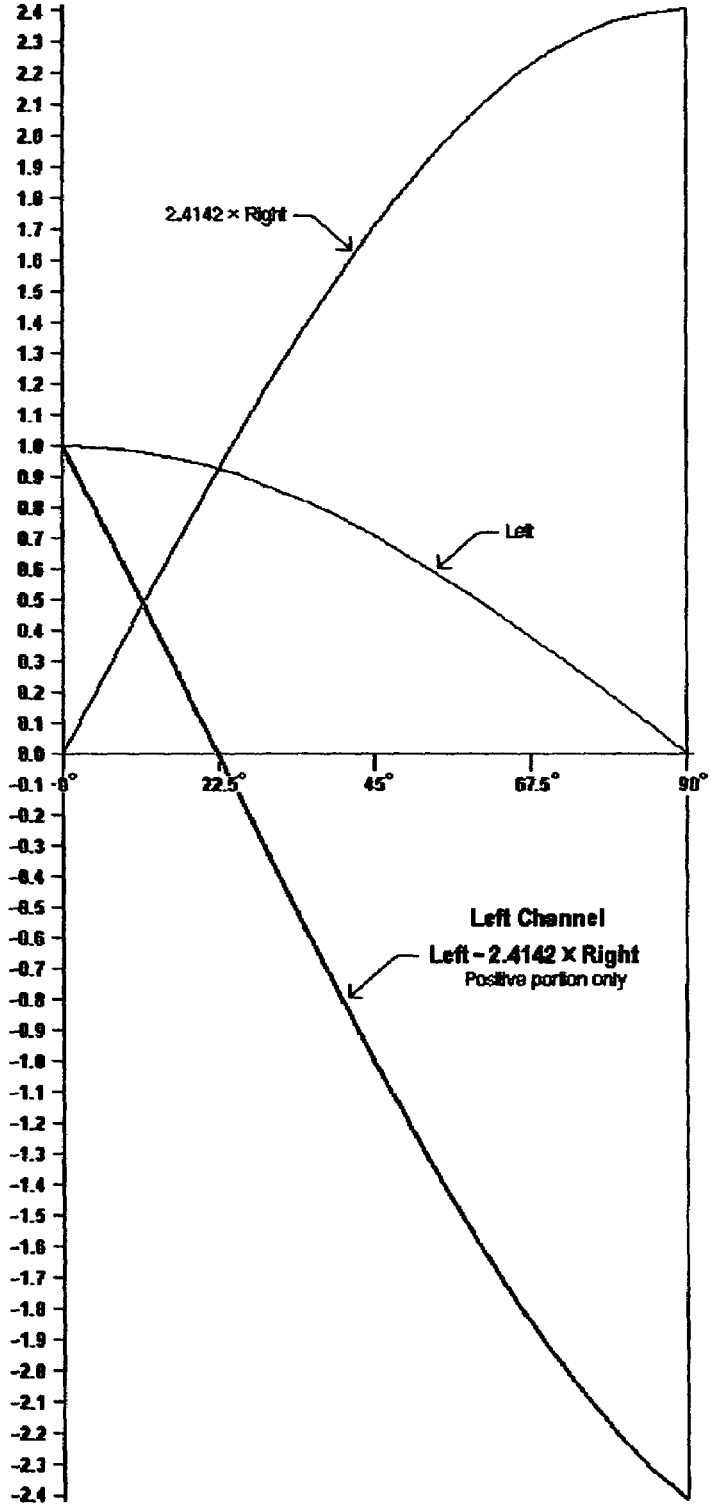
FIG. 6 illustrates the derivation of the left channel.

The left output can be derived by subtracting 2.4242 times the right input from the left input and discarding the negative portion. Here the constant 2.4142 is the tangent of 67.5 degrees and is chosen to force the left output to be zero at a positional angle of 22.5 degrees. FIG. 6 is a graph representing this derivation of the left channel.

Figure 7:
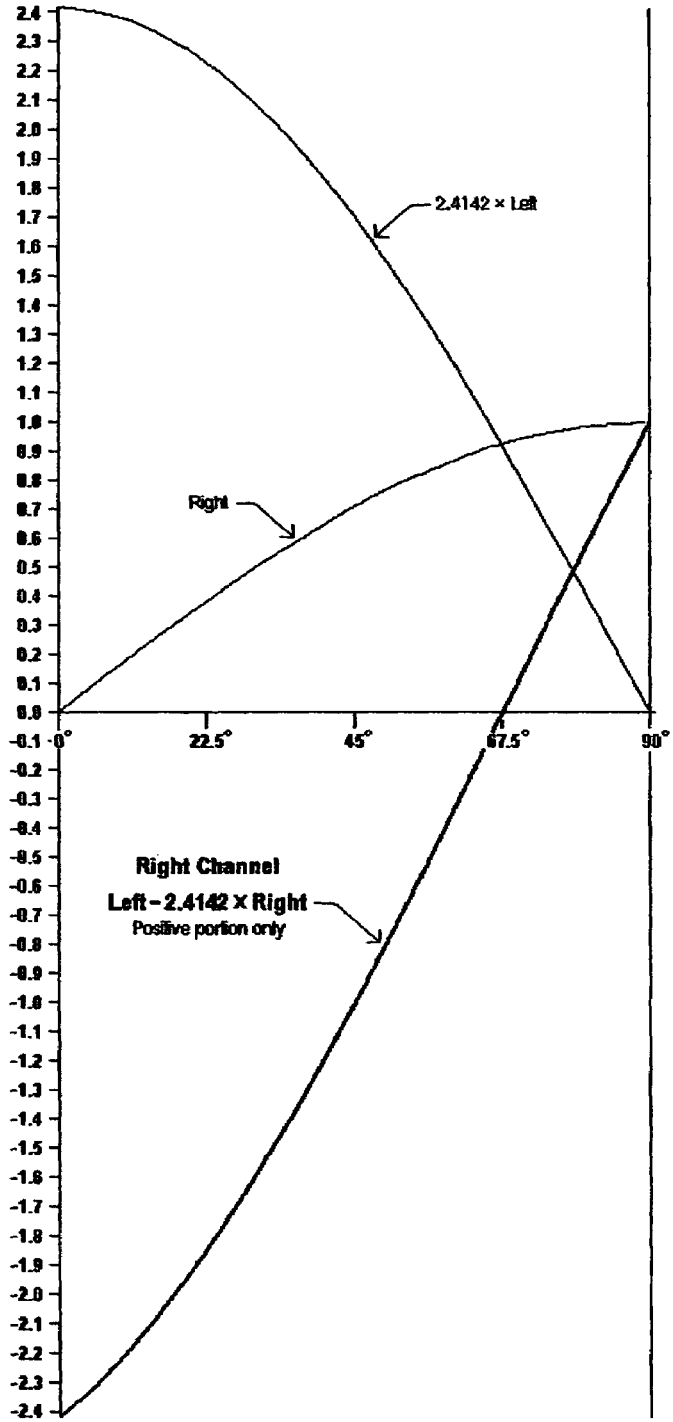
FIG. 7 is a graphic illustration of the derivation of the right channel.

The right output can be derived by subtracting 2.4242 times the left input from the right input and discarding the negative portion. Here the constant 2.4142 is the tangent of 67.5 degrees and is chosen to force the right output to be zero at a positional angle of 67.5 degrees. FIG. 7 is a graph representing this derivation of the right channel.

If the previously mentioned flag has been set when relative phase angle was greater than ninety degrees, indicating the output is destined for the rear channels, the outputs derived above are transferred to the rear channels: left-center to left-rear, center to center-rear, and right-center to right-rear. Subsequently the previously calculated and stored uncorrelated signal is added to the larger of the left-rear or right-rear output.

Figure 8:
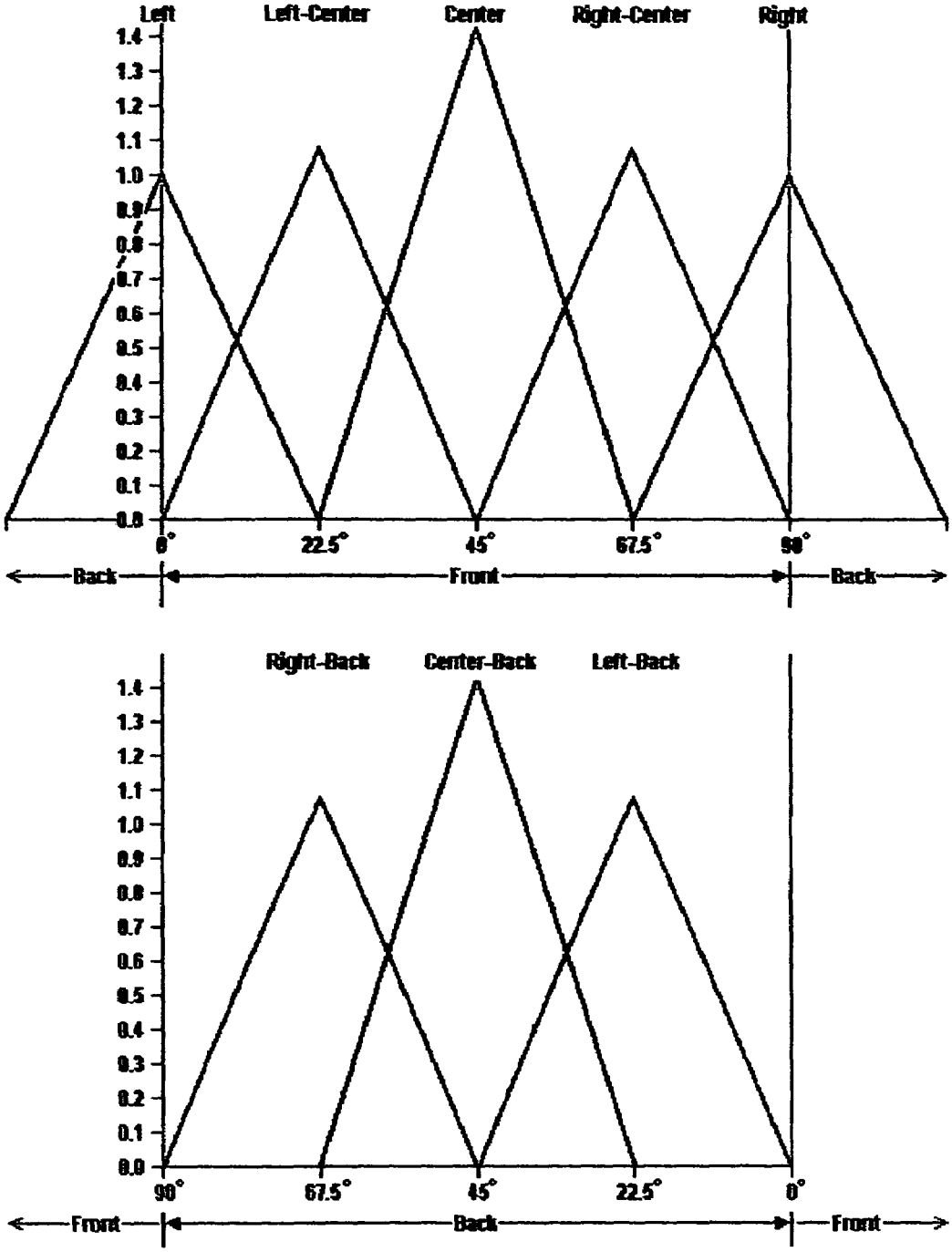
FIG. 8 depicts channel output versus stereo soundstage position angle for an eight channel separation.

FIG. 8 is a depiction of the channel output versus position for all eight channels at this stage in the process as explained herein. The process, as actually implemented, combines certain separately discussed processes for efficiency.

FIG. 9 is a depiction of the ideal channel output versus position for all eight output channels. The positional response depicted in FIG. 9 is the pan-pot equations repeated for each pair of adjacent output channels. To convert the channel output depicted in FIG. 8 into that depicted in FIG. 9, the output of each channel is multiplied by a pre-calculated correction factor determined by dividing the quantities shown in FIG. 9 by the quantities shown in FIG. 8. This application of the correction factor is possible because the equations depicted in FIGS. 8 and 9 are completely known and are independent of the magnitudes of the left and right input signals. As presently implemented, the ratio of ideal output to actual output (the correction factor) is precalculated at one degree positional angle increments and stored in a LookUp table. As each channel output is derived it is multiplied by the correction factor (stored in the LookUp table) for its position, thus producing the desired output versus position characteristic.

While the channel output versus position depicted in FIG. 9 is the theoretical ideal, better practical results are obtained by inserting gaps or dead spots between channels that become zero at the same position. Inserting inter-channel gaps helps in reducing the previously described chirping or "birdies". FIG. 10 depicts channel output versus position with relatively small inter-channel gaps. The flattening of the tops and extension of the skirts at the bottom is a result of the requirement for the sound power to remain constant as the phantom image is moved across the stereo soundstage. Phantom images may only be produced where adjacent channels overlap, and inserting inter-channel gaps reduces these regions. The preferred embodiment of the current invention employs gaps about three positional degrees wide, which are effective in reducing "birdies" and are sufficiently narrow to allow good phantom image formation.

FIG. 11 depicts the output versus position response with inter-channel gaps that are relatively wide, but not so wide as to preclude adjacent channel overlap. The tops have become flatter, the sides steeper, and the skirts more abrupt. The regions where phantom images may be created are substantially reduced.

FIG. 12 depicts the output versus position response when the inter-channel gaps are just sufficiently wide to preclude any channel overlap. At this point the ability to produce phantom images is lost. If moved, a sound will jump abruptly from one output channel to the next.

FIG. 13 depicts the output versus position response with wide inter-channel gaps. There is no possibility of maintaining constant sound power as the sound source is moved across the stereo soundstage. No phantom images can be formed. Sounds in the input that fall within the inter-channel gaps will not appear in the output.

FIG. 14 depicts the output versus position response with the inter-channel gaps set to their maximum value. There is no possibility of maintaining constant sound power as the sound source is moved across the stereo soundstage. No phantom images can be formed. Sounds in the input will appear in the output only if they occur at positional angles of 0, 22.5, 45, 67.5, or 90 degrees. The currently preferred embodiment limits the minimum output channel width (not inter-channel gap) to three positional degrees, and output channel width must remain greater than zero or there will be no output from the channel.

Although user-adjustable control of the foregoing output versus positional response characteristics is unnecessary for many applications, such control may be advantageously incorporated to allow greater user choice in creating desired channel separations and resulting sound effects.

The current invention, as presently implemented, differs slightly from the foregoing discussion. Specifically, the derivation of the left and right output channels is accomplished by simply multiplying the left and right inputs by the desired output versus position divided by the cosine or sine (respectively) of the position angle.

Move Front Echo to Back

Echoes (room reverberation) captured in sound recordings contains both in-phase and out-of-phase components. As described above, the uncorrelated signal and echo components that are more than ninety degrees out-of-phase have been placed in the rear channels, where they are deemed to belong. Echo components with relative phase angles less than or equal to ninety degrees remain in the front channels, and removal of these components requires additional processing. This processing consists of maintaining an artificially created echo signal for each front channel and using this echo signal to diminish the output from all other front channels. In one implementation echoes in the left-center channel are transferred to the left-rear channel, echoes in the center channel are transferred to the center-rear channel, and echoes in the right-center channel are transferred to the right-rear channel. Alternate echo-transfer assignments may be employed. As each front channel is diminished, the portion of the signal removed is added to the corresponding rear channel. Left and right channels are not subjected to the echo removal process, but echoes of the left and right channels are removed from the remaining front channels.

A principle characteristic of echoes is that they diminish as time passes: they are said to decay. Causing the artificially created echo signals to decay is accomplished by multiplying them by a quantity herein referred to as the Decay Factor. The Decay Factor must be zero or greater but strictly less than one. The Decay Factor may be a fixed value set by the user or it may vary dynamically in response to some characteristic of the signals present during processing. Preferably, the Decay Factor is dynamically varied based upon a comparison of the magnitude of the artificial echo signals to the magnitude of the rear channel output signals. Adjustment of the Decay Factor is made after all the frequency components in the input Fourier Transforms have been processed but before processing of the next Fourier Transforms begins. This adjustment may be performed at other points in the process.

The artificial echo signal for each channel is initially set to zero. In subsequent processing steps, the echo signal for each channel is compared to the magnitude of the signal in said channel. If said channel magnitude is larger than said echo magnitude, the echo magnitude is set equal to the channel magnitude. Otherwise no action is taken. As time passes the said echo signal diminishes due to the action of the Decay Factor, eventually either becoming zero or less than the said channel magnitude, whereupon it is reset to equal the channel magnitude as previously discussed.

As each front channel is derived its magnitude is compared to the combined magnitudes of the echo signals for all other Front channels. For example, the center channel is compared to the sum of the echo magnitudes for the left, left-center, right-center, and right channels. If the combined echo signal is equal to or greater than the front channel magnitude, all of the front channel magnitude is transferred to the corresponding rear channel and the front channel is set to zero. If the combined echo magnitude is less than the front channel magnitude, the combined echo magnitude is assigned to the corresponding rear channel and the front channel magnitude is diminished by the magnitude of the combined echo signal.

The total power of all output channels must equal the total power of the left and right inputs. Power is related to the square of the magnitude. The output channel magnitudes are proportionally corrected to force the sum of the squares of the channel magnitudes to equal the sum of the squares of the left and right input signals.

The above steps are to be performed for each frequency component in the input Fourier Transforms.

Optional Additional Processing

After the above steps have been performed for each frequency component in the input Fourier Transforms, all positional output signals have been derived and may be subjected to further processing. Such additional processing may include the introduction of a time delay into the rear channel outputs, or applying another means of "decorrelating" the rear channels. Other possibilities include various forms of signal enhancement such as dynamic range compression or expansion. It should be noted that no psycho-acoustic effects, such as introducing time delays, Haas effects, frequency or spectrum masking and the like, are required to generate outputs according to the present invention. In the event that it should be desired to utilize any psycho-acoustics, those effects should only be applied after all of the positional output signals have been derived. Applying psycho-acoustic effects prior to separating the output signals would pollute the original signal and greatly complicate the task of separating independent output channels.

As mentioned above, the total power of all output channels should equal the total power of the left and right inputs. Although this corrective step was previously performed in connection with moving the front echo, any subsequent processing of the output signals that may have occurred may have also altered the total output power, necessitating a second power equalization step. Instead of equalizing the power at each frequency as described previously, this step alters the magnitude of each frequency component in the output Fourier Transforms based upon a correction factor derived from the sum of the squares of the magnitudes taken over all frequencies in all output channels.

Generate Color Organ Outputs

Color organ displays are typically based upon a small number of relatively wide frequency bands. Most color organs employ three ill-defined frequency bands loosely termed "low", "middle", and "high". The current invention provides a number of frequency bands far exceeding the perceived need or usefulness for producing a visual display. Some means, left to the discretion of the designer of any particular implementation, is employed to convert the many narrow frequency bands produced by the processing of this invention into a smaller number of wider frequency bands, generally about three to eight bands, suitable for the generation of a visual display. The exact means employed is subject to wide interpretation of artistic and aesthetic values. The simplest implementation may simply be to assign a particular color to a particular audio frequency band. However, color intensity may correspond to loudness of music or musical tempo or degree of harmony or dissonance in the music. Alternatively, it may even be possible to assign particular colors to individual instrument types or voices.

Figure 15:
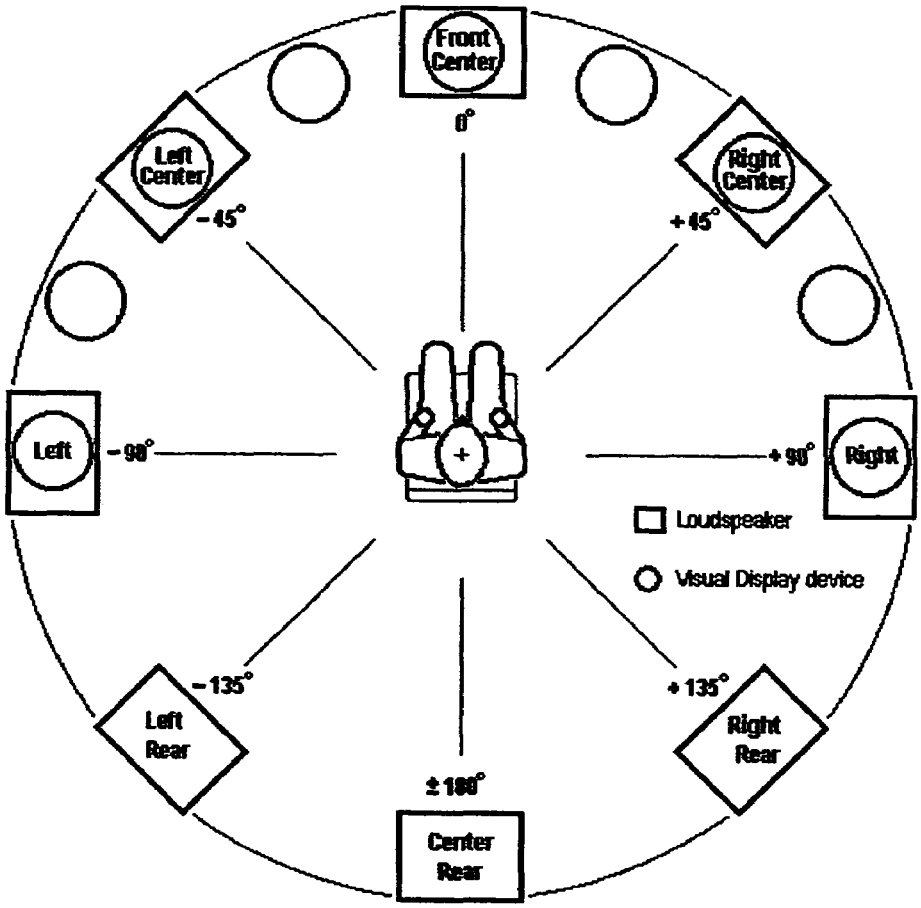
FIG. 15 depicts an ideal eight speaker placement with nine color organ visual display devices.
Figure 16:
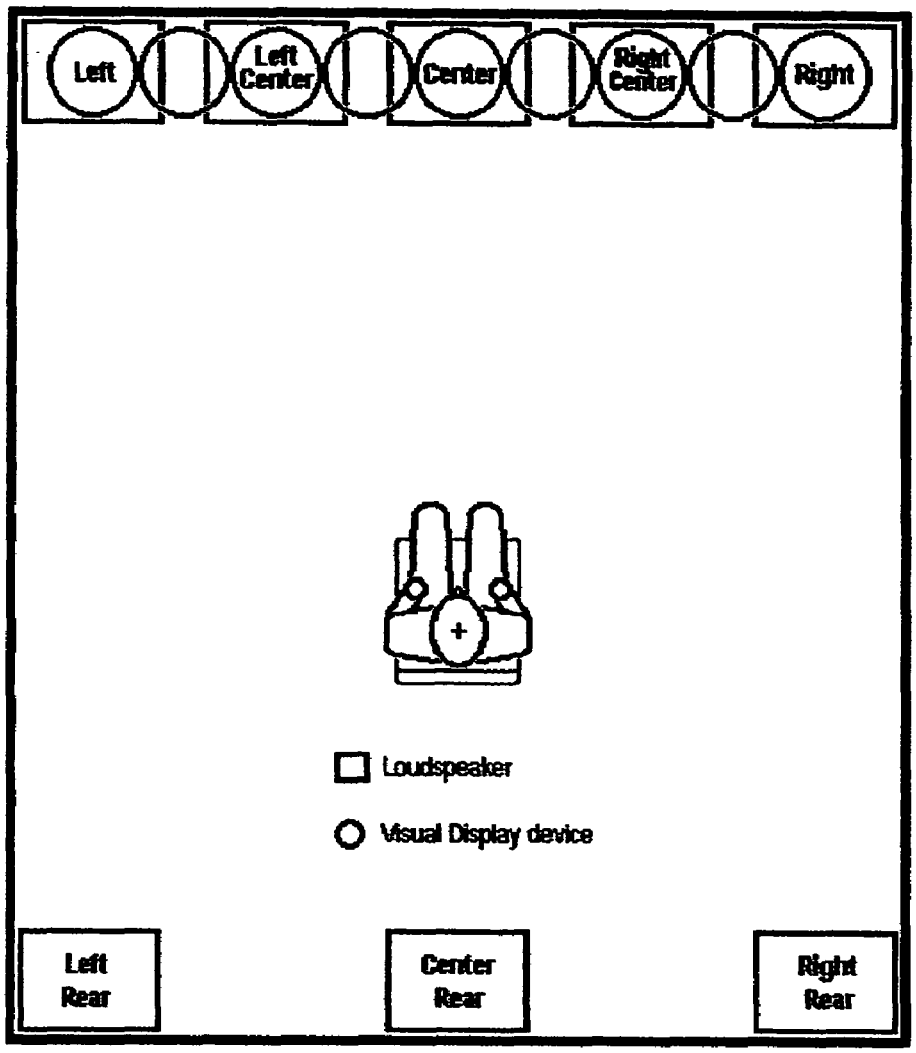
FIG. 16 depicts a representative placement of speakers and visual display devices for eight channel separation.

One color organ output positional channel is created for each of the front audio output positional channels. While five front positional channels are generally sufficient for audio output, they may be insufficient for generating a compelling visual display. As a signal is moved ("panned") from one side of the stereo soundstage to the other, each channel fades out as the signal leaves it and fades in as the signal approaches it. For sound, this produces a moving phantom image, but with light the result is a number of stationary images growing brighter and dimmer. One solution to this dilemma is to add more images (positional channels) to the color organ output. One implementation provides for the generation of additional color organ output channels falling between the audio output channels. The method of generating additional channels is essentially identical to the means previously discussed in the section entitled "Generate Output Channels", except that no rear channels need be generated. The audio output channels are taken in pairs of adjacent channels; the left-most channel in said pair adopts the role of the left input in the aforesaid previous discussion, and the remaining channel in said pair adopts the role of the right input. If the process discussed above in the section entitled "Generate Output Channels" is employed exactly as described, three color organ output channels will be created between each pair of front audio output channels. The exact number of additional color organ outputs created between adjacent audio output channels is left to the discretion of the designer of any particular implementation, depending upon the requirements of space, costs, and aesthetics. In FIGS. 15 and 16, one additional color organ output is generated between each pair of front audio output channels, producing a total of nine color organ output positional channels.

Generation of color organ outputs from the rear channels is possible and may be implemented at the discretion of the designer. There is little perceived need for such color organ output channels in a private home, but such channels may be desirable in concert halls, theaters, planetaria, and other venues of public exhibition.

Generate Output Fourier Transforms

The positional channel outputs generated thus far are sharply defined. Such sharp definition is desirable for the generation of a visual display, but may not be ideal for the generation of signals intended for conversion into sonic output. Some cross-channel blending of the output signals is beneficial in suppression, or masking, of the chirping or "birdies". Adjacent output channels may be combined by constructing a signal referred to as the "Bleed Signal" and then combining said Bleed Signal with the output channel for which it was constructed.

Bleed Signals are constructed from the output channels on either side of and immediately adjacent to the output channel for which the Bleed Signal is being constructed. For instance, the Bleed Signal for the center output channel is constructed from the left-center and right-center output channels. A Bleed Signal is composed by inspecting each of the two output channels from which it is being constructed on a frequency-by-frequency basis. At each frequency, the larger frequency component is included in the Bleed Signal. The Bleed Signal is attenuated. The amount of attenuation may be a constant value chosen by the designer of any particular embodiment, may be a variable value derived from one or more characteristics of the signals present during processing, or it may be controlled by the operator or user of the multi-channel audio system.

The Bleed Signal is applied to its target output channel on a frequency-by-frequency basis. At each frequency, the target output channel magnitude is replaced with the Bleed Signal magnitude only if the Bleed Signal magnitude is larger than the target output channel magnitude. Combining Bleed Signals with the output channels increases the total output power, necessitating another input/output equalization step. Said equalization is typically performed on a frequency-by-frequency basis as previously discussed, but other equalization means may be employed.

At this stage of the process, the output magnitude and Real/Imaginary ratio have been determined (as discussed in the sections Detect Left/Right Phase and Calculate Output Phase) for each output channel for every frequency component defined by the Fourier Transforms of the left and right input signals. In this form, the output information does not constitute a proper Fourier Transform. A proper Fourier Transform composed of so-called Real and Imaginary parts is generated for each output channel by multiplying the output channel magnitude at each frequency by the Real/Imaginary ratio for that frequency and output channel.

Inverse Fourier Transform

Each output channel Fourier Transform is subjected to an Inverse Fourier Transform in order to produce an audio-frequency output signal for said output channel. Any of a variety of available implementations of algorithms for performing Fast Fourier Transforms (FFT) and Inverse Fourier Transforms (IFT) may be used.

Other Considerations

FIG. 15 depicts the placement of loudspeakers and visual display devices relative to the listener as mandated by the mathematical model underlying the invention. Loudspeakers are represented as rectangles and visual display devices are represented as circles.

FIG. 16 depicts a more practical placement of loudspeakers and visual display devices. As in FIG. 15, loudspeakers are represented as rectangles and visual display devices are represented as circles.

Emulating the Dolby 5.1 Audio System

The current invention may be employed to emulate existing multi-channel audio playback systems. As an example of such emulation, a brief discussion of an embodiment for generating a Dolby 5.1 compatible output is outlined. The output generated is not necessarily identical to the output generated by a true Dolby 5.1 system, but the generated output can be successfully reproduced by an audio playback device designed for Dolby 5.1 program material.

Figure 17:
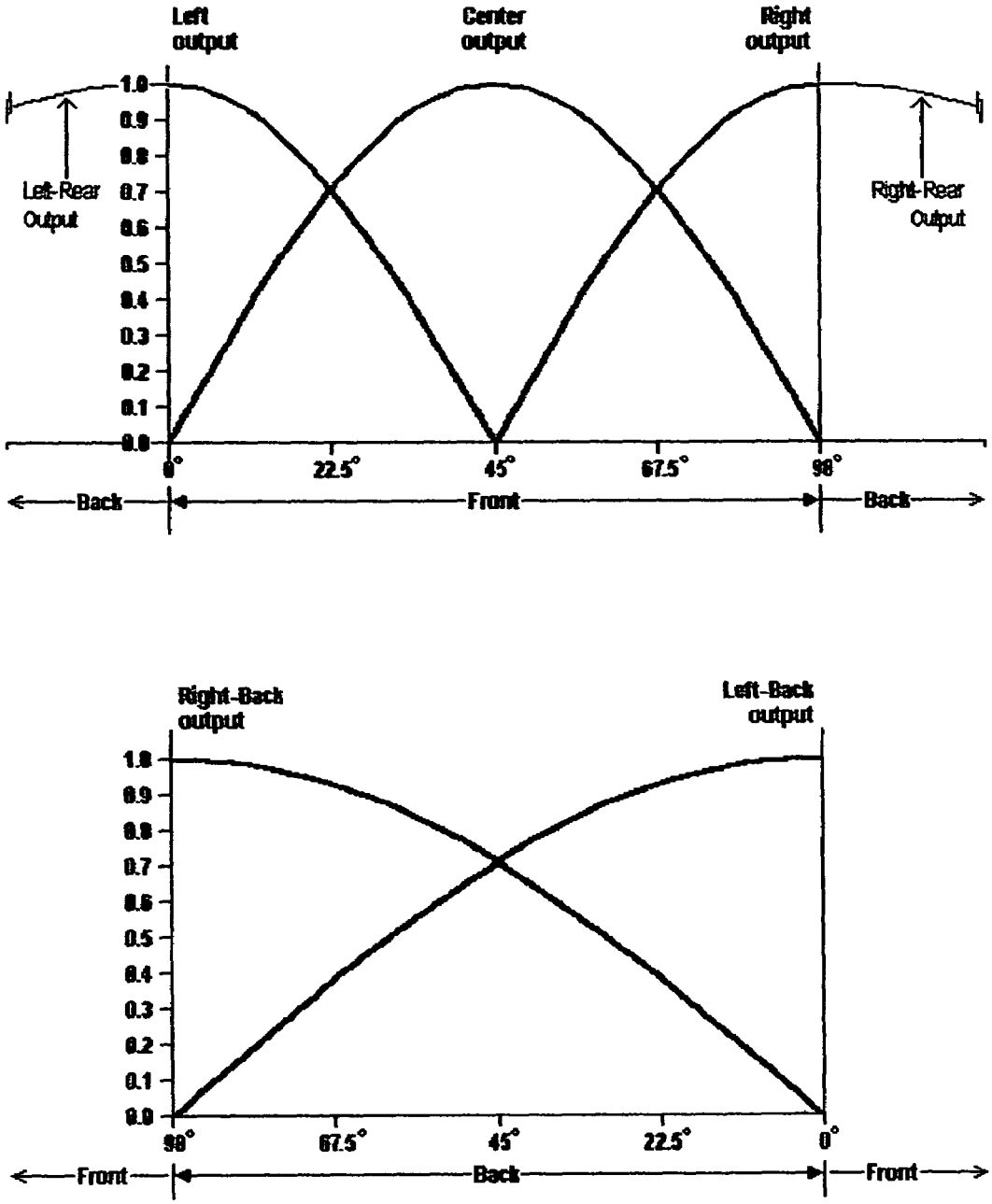
FIG. 17 is a graphical depiction of channel output versus stereo soundstage position of the Dolby 5.1 emulation that generates five output channels.

FIG. 17 depicts the desired Channel Output vs Position graph of a Dolby 5.1 emulation. Three front and two rear channels are generated. In addition, an "Effects" channel (not shown) consisting of low frequency information is created.

Figure 18:
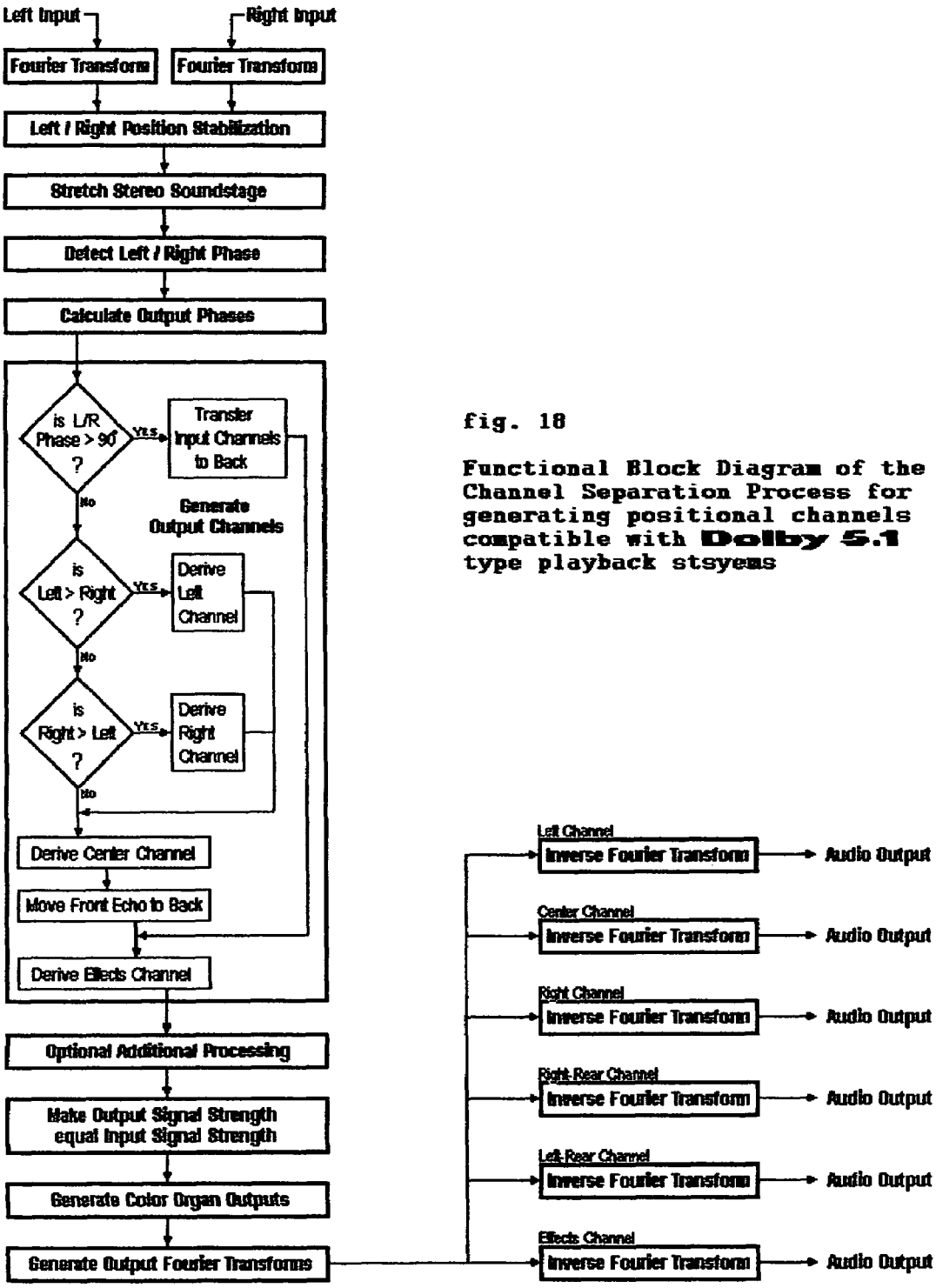
FIG. 18 is a functional block diagram of the channel separation process for Dolby 5.1 emulation.

Unlike the foregoing general discussion of the invention, the Dolby 5.1 system is not symmetrical in that the number of rear channels is not identical to the number of Front channels (disregarding the left & right). This asymmetry necessitates minor alterations to the current invention. FIG. 18 is a functional block diagram of the channel separation process illustrating the alterations thus required. The ordering of the steps involved is modified for efficiency, and only the alterations in the process need be explained.

The rear channels are composed of the portions of the input signals that exhibit a relative phase angle of more than ninety degrees. Because the rear channels are created by a simple transference of input to output there is no need to modify the positional response characteristics. The rear channels in the Dolby 5.1 system exhibit a restricted frequency response. Frequencies below an arbitrarily chosen value are moved from the rear channels to the Effects channel, to be discussed later.

Figure 19:
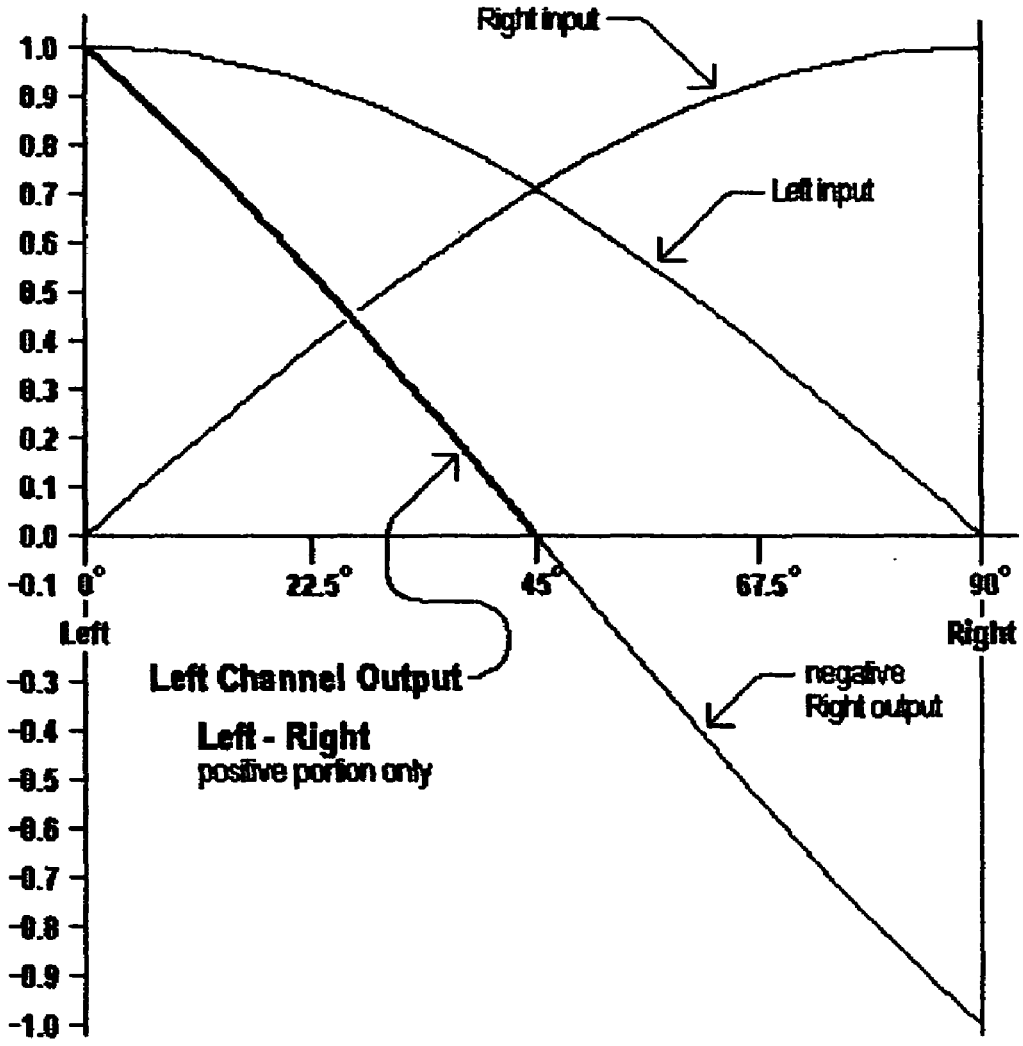
FIG. 19 is a graphic depiction of the derivation of the left output channel in the Dolby 5.1 emulation.
Figure 20:
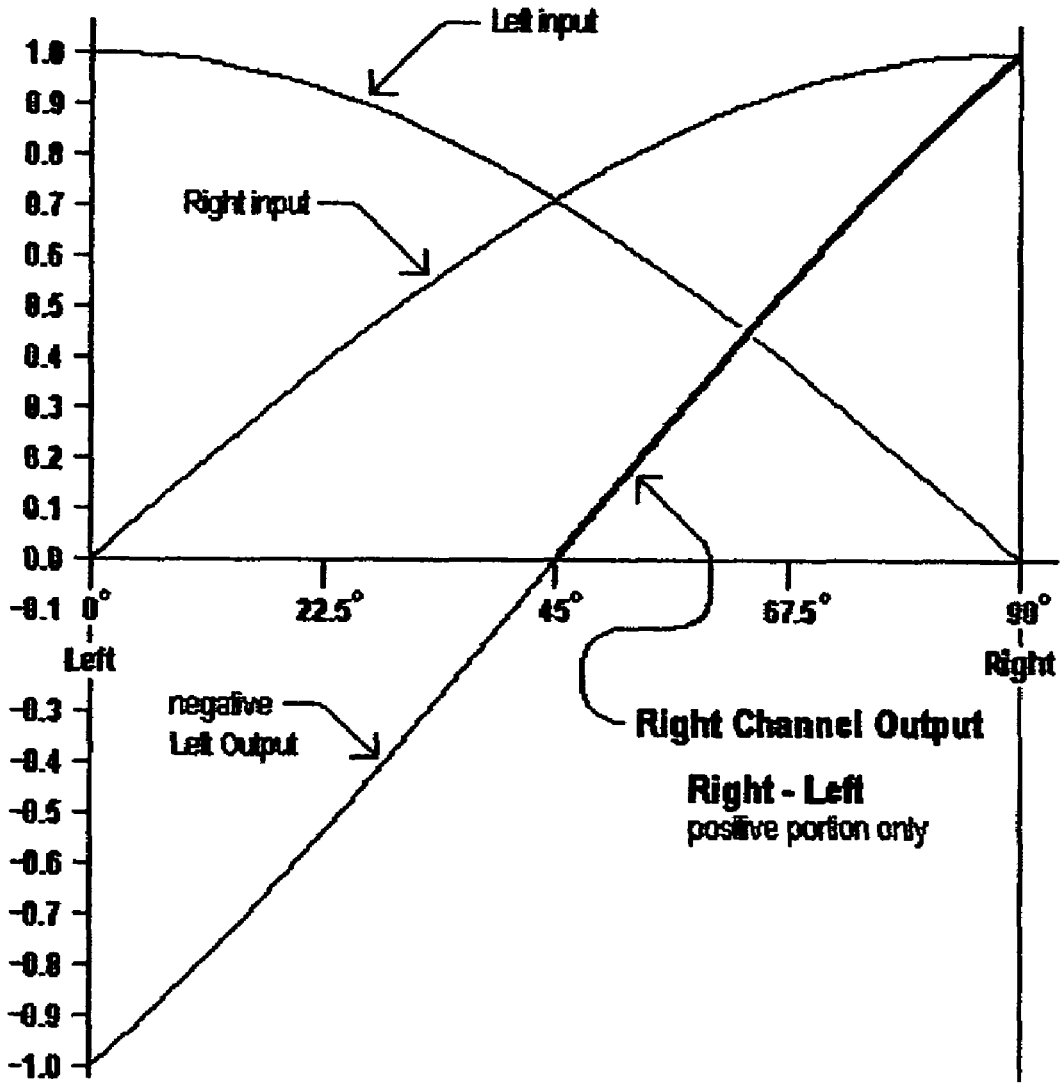
FIG. 20 is a graphic depiction of the derivation of the right output channel in the Dolby 5.1 emulation.
Figure 21:
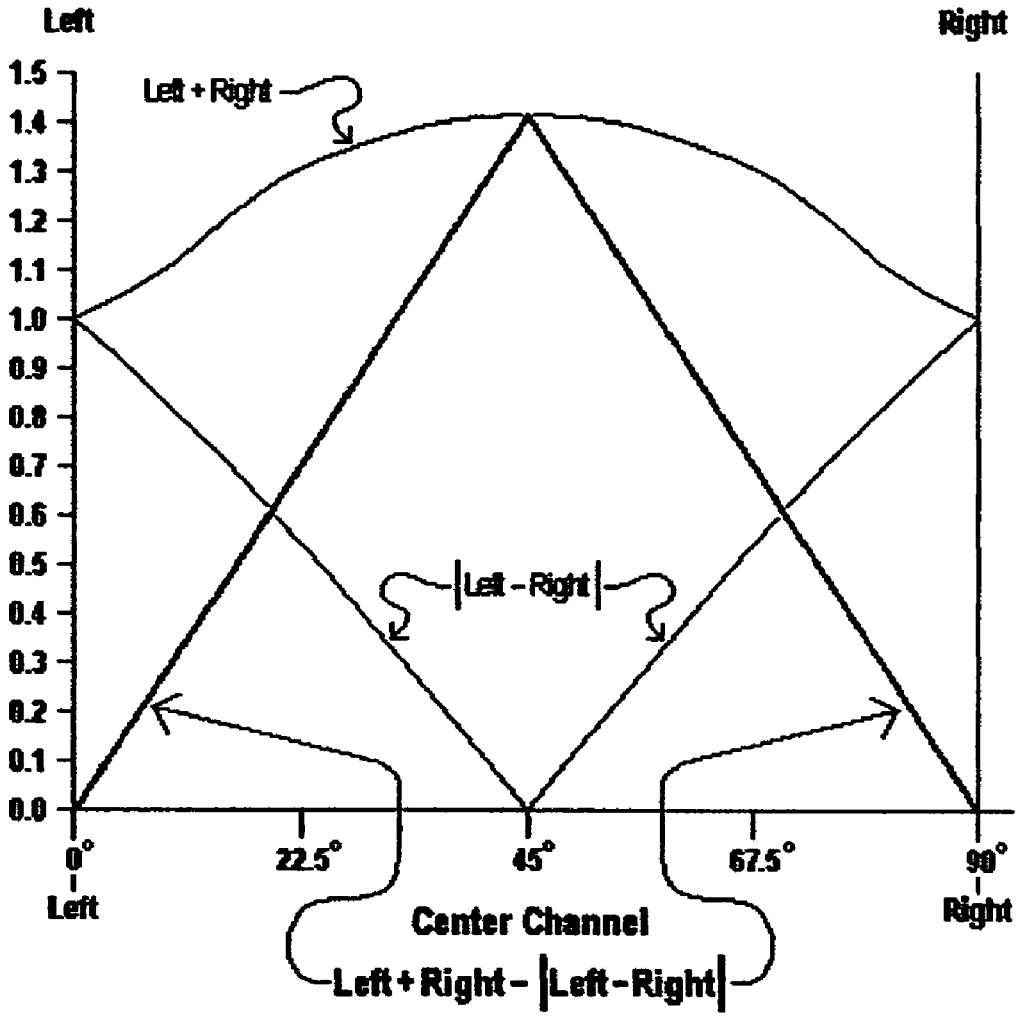
FIG. 21 is a graphic depiction of the derivation of the center output channel in the Dolby 5.1 emulation.

Unlike the general discussion of the current invention, in emulating the Dolby 5.1 system it is more computationally efficient to derive the left and right channels before deriving the center channel. The right input magnitude is subtracted from the left input magnitude. If the resulting quantity is positive it is assigned to the left output channel, and if negative it is assigned to the right output channel after the algebraic sign is changed (making it positive). In either case the left and right outputs thus generated are summed (producing the absolute value of the left–right difference) and this quantity is subtracted from the sum of the left and right inputs yielding the center channel output. The foregoing process is illustrated in FIGS. 19, 20, and 21. FIG. 19 depicts the derivation of the left output channel. FIG. 20 depicts the derivation of the right output channel. FIG. 21 depicts the derivation of the center output channel.

FIG. 22 is a graph of the Channel Output vs Position for all outputs thus far generated by the Dolby 5.1 emulation. The output depicted in FIG. 22 is converted to the desired output depicted in FIG. 17 as described in the general discussion section entitled "Generate Output Channels".

The "0.1" in Dolby 5.1 refers to a low frequency "Effects Channel" used to add percussive effects such as the "thump" of an explosion or gunfire or a bass drum. The Effects channel is optional and thus may not be implemented in any particular audio playback system. Consequently no audio program material vital to the successful reproduction of a recording is placed in the Effects channel.

Conventional stereo recordings do not contain program material intended for playback through the Effects channel. To utilize the Effects channel, such program material must be synthesized. Because said synthesized program material is not present in the original recording, the Effects channel is not included in any calculations aimed at equalizing the input and output power. The Effects channel is synthesized by summing the portion of the front output channels below an arbitrarily chosen cutoff frequency, typically about 250 Hz, with the signal previously created when the low frequency portion of the rear channels was moved to the Effects channel. The resulting sum is then frequency-shifted down by one and two octaves. The resulting two signals are summed with the non-frequency-shifted sum and the result is subjected to further frequency response shaping. The resulting signal is assigned to the Effects channel output.

Because the Dolby 5.1 emulation produces three Front channels instead of the five channels assumed in the general discussion, some modification must be made to the generation of Color Organ outputs. As described in the previous general discussion entitled "Generate Color Organ Outputs", additional color organ outputs may be created between any two adjacent output channels. One additional Color Organ output is created between the left and center output channels and another between the center and right output channels. The resulting five (left, left-center, center, right-center, and right) color organ outputs are then treated as described in the general discussion. For instance, the five outputs may be used to create the generally preferred nine color organ outputs, as the five channels are used to create nine color organ outputs in the general discussion.

Figure 23:
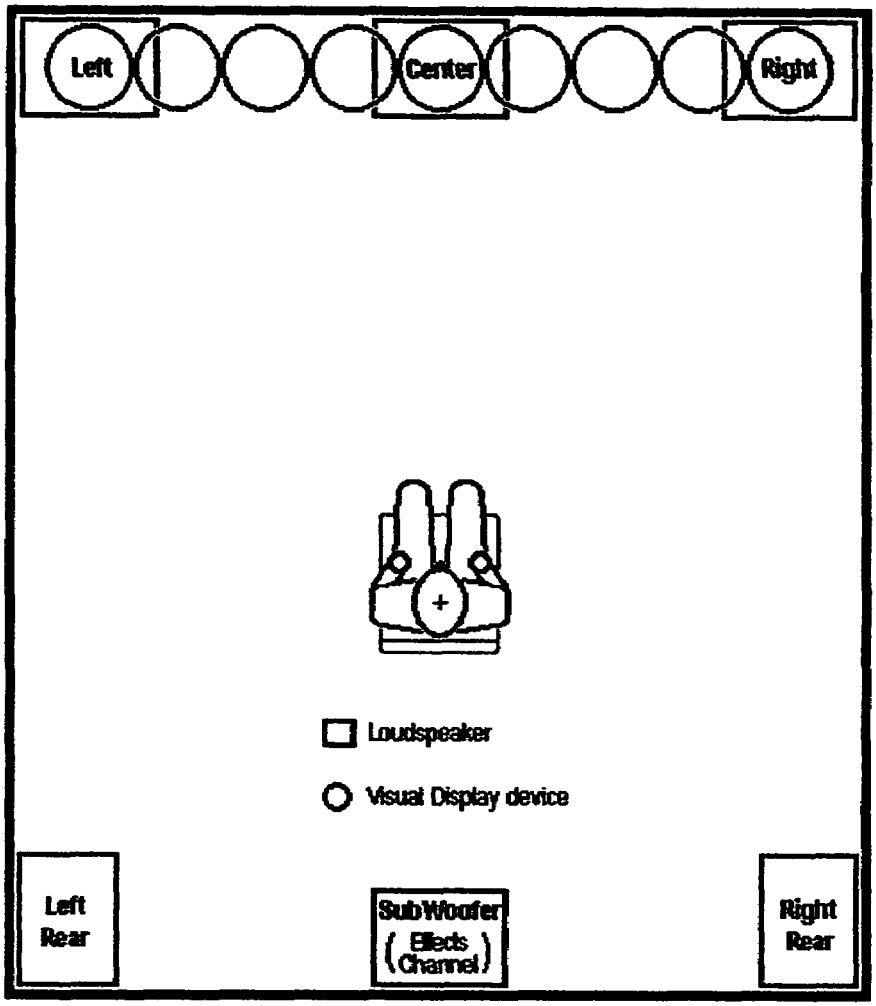
FIG. 23 depicts representative loudspeaker placement for a five channel Dolby 5.1 audio system.

FIG. 23 depicts Loudspeaker and Color Organ placement for the Dolby 5.1 emulation. The placement of the Effects channel loudspeaker (labeled SubWoofer in FIG. 23) is not critical and is shown directly behind the listener for clarity of illustration only.

Generating Four Positional Channels

Figure 24:
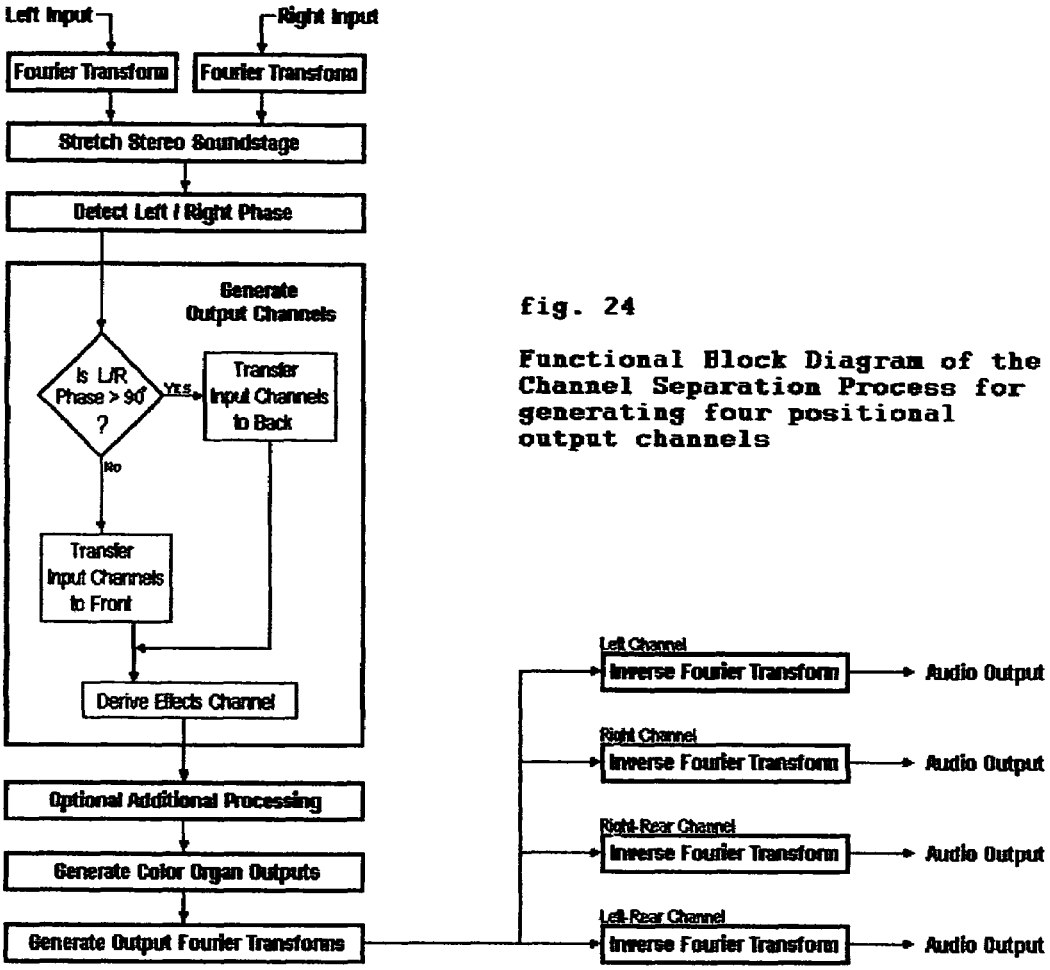
FIG. 24 is a functional block diagram of the present invention applied to a four channel separation process.
Figure 25:
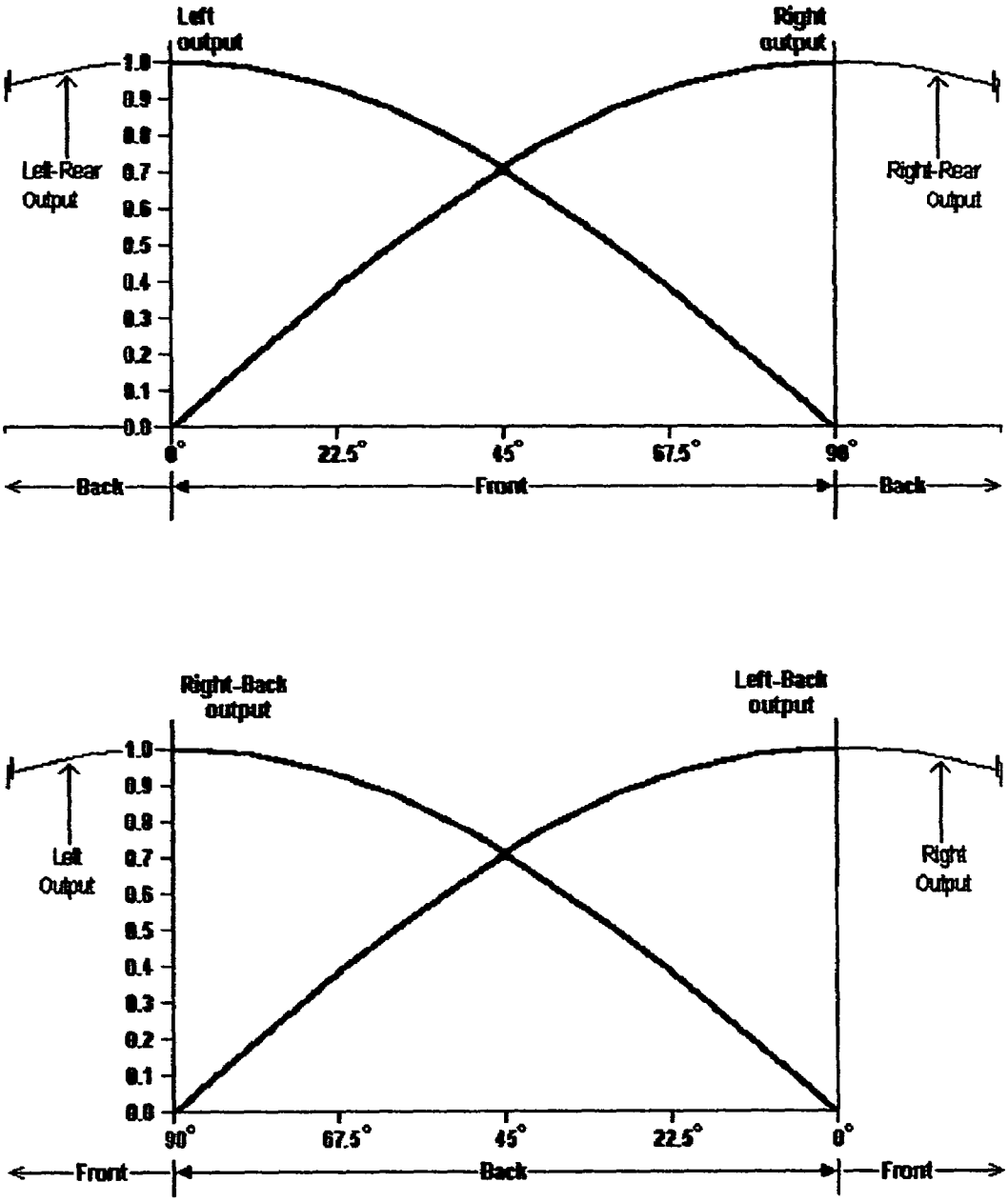
FIG. 25 depicts channel output versus stereo soundstage position angle for four channels in the separation process.

In addition to making the Effects channel optional, some audio playback equipment also makes the center channel optional. If the user chooses to forego the center channel, the signal normally sent to the center channel is mixed with the left & right output channels, producing a phantom image as in conventional stereo recordings. A playback system thus configured has four positional channels: left, right, right-rear, and left-rear. The current invention may also be employed to generate these four positional channels. If the relative phase of the left and right input channels is greater than ninety degrees the inputs are assigned to the rear output channels. The left input is assigned to the left-rear and the right input is assigned to the right-rear. If the relative phase of the left and right inputs is ninety degrees or less the inputs are assigned to the front channel outputs (left to left and right to right). Because the input signals are directly routed to the output channels unaltered, no output phase calculation is needed, and no channel output vs position processing is required. Thus, many of the steps depicted in FIGS. 2 and 18 may be eliminated. FIG. 24 is a Functional Block Diagram of the current invention employed to generate four positional output channels. FIG. 25 depicts the output vs position for all output channels in the four channel configuration.

Figure 26:
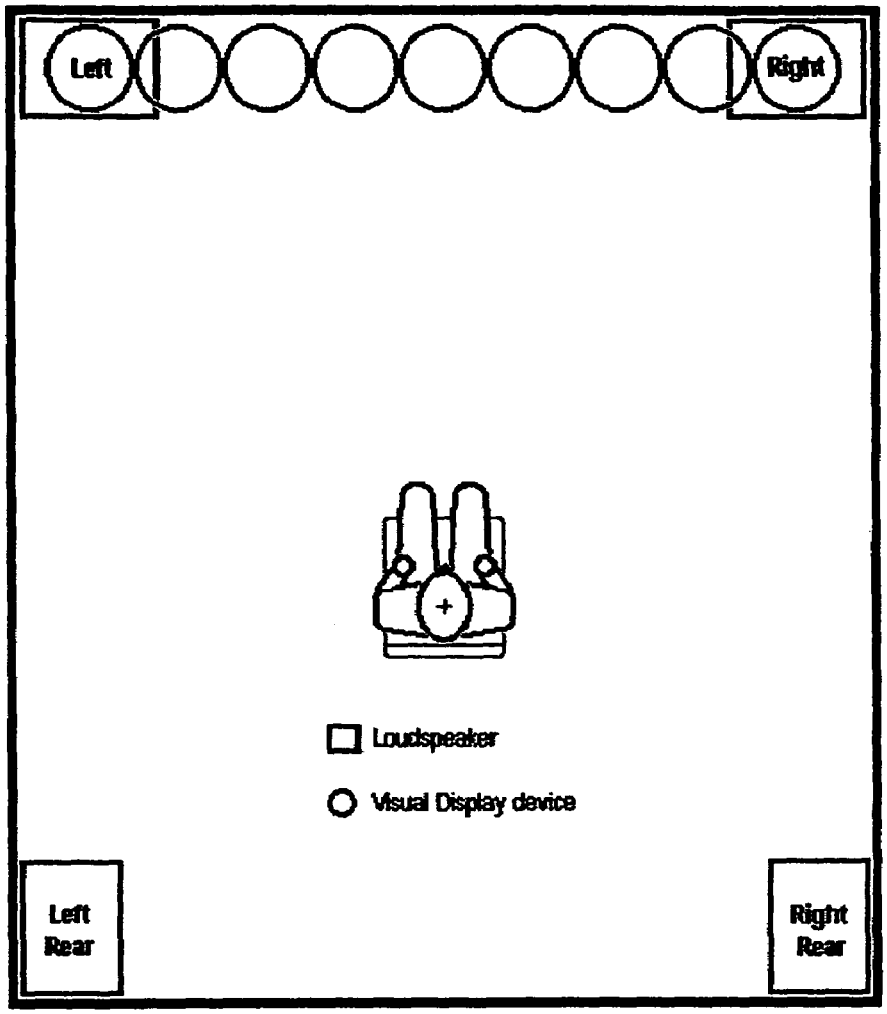
FIG. 26 depicts representative loudspeaker and visual display placement for four channel system.

As described in the general discussion section entitled "Generate Color Organ Outputs", additional color organ outputs may be created between any two adjacent output channels. The center Color Organ output may be created by generating one output between the left and right output channels. Subsequently one additional Color Organ output is created between the left and center output channels and another between the center and right output channels. The resulting five (left, left-center, center, right-center, and right) Color Organ outputs are then treated as described in the general discussion. FIG. 26 depicts loudspeaker and Color Organ placement for a four channel playback system employing nine visual display devices. Although no Effects channel is shown in FIG. 26, the Effects channel may be synthesized as depicted in FIG. 24 and made available for optional inclusion in a four channel playback system.

Generating Multiple Positional Output Channels from a Stereo Pair

Three approaches for generating additional potential output channels from a stereo pair are possible, one recursive and two direct. The recursive approach, although theoretically sound, has failed to perform as well as the direct approaches. In addition, the recursive approach is limited to producing an odd number (1, 3, 5, 7 . . . ) of positional channels intermediate the two input channels. The limitation of the recursive approach to an odd number of intermediate output channels is not as restrictive as it might, at first, seem because a center channel is almost always among the desired output channels. Any balanced collection of linearly arrayed objects (including output channels) that has an object at the center position must contain an odd number of objects. The recursive approach is employed in the generation of color organ outputs between adjacent audio output channels, while the direct approaches are the preferred methods for generating the audio output channels. The direct approaches allow any number (even or odd) of intermediate channels to be generated.

The following principle underlies all three approaches: Given two input signals (herein termed "left" and "right") that are known to follow a given set of rules (pan-pot equations) that uniquely define the relative magnitudes (and possibly phase) of the two input signals as a function of position, the position of any thus encoded signal may be determined from the relative magnitudes (possibly in conjunction with relative phase) of the input signals. Once the position is known, the magnitude (and possibly relative phase) of the originally encoded signal may be reconstructed. In order to avoid loss of lucidity in the following discussion, the underlying pan-pot equations are assumed to be the trigonometric functions sine and cosine, where the sine is associated with the right signal and the cosine is associated with the left signal. Other pan-pot equations are possible, and if employed, the following discussion should be modified accordingly.

All input and output magnitudes are assumed to be positive or zero. No negative magnitudes are allowable.

Figure 28:
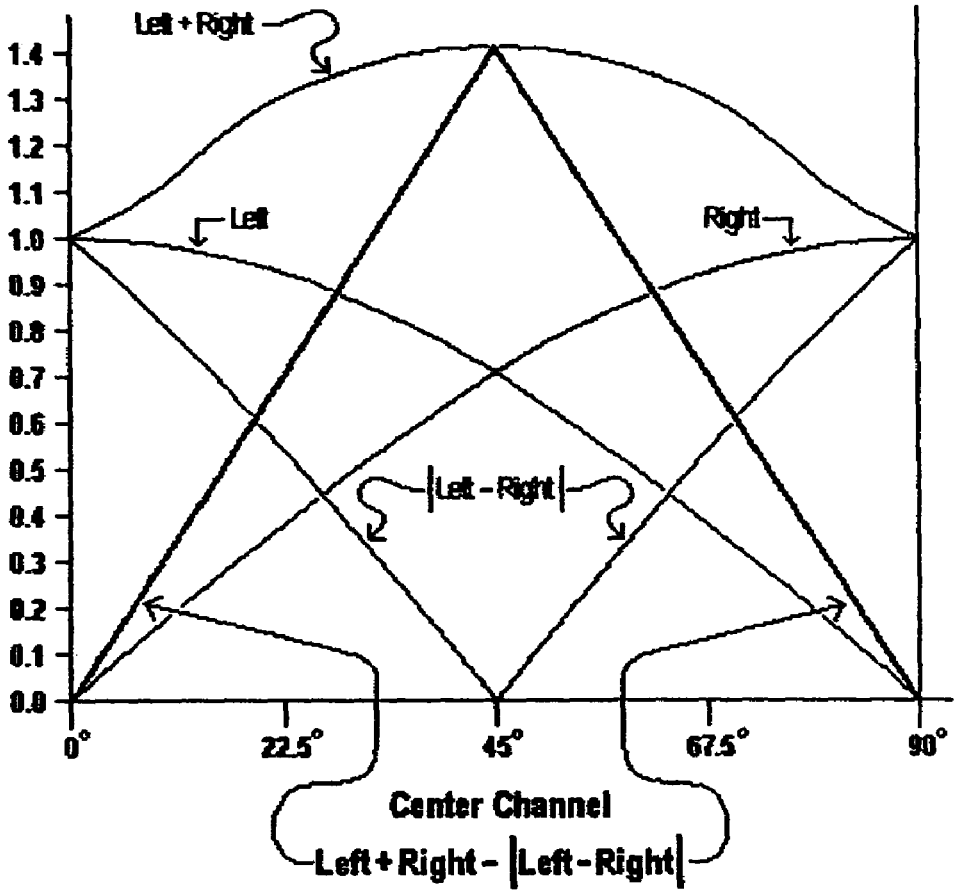
FIG. 28 graphically illustrates the generation of intermediate output channel.

The recursive approach will be discussed first. One output channel is to be created midway between two input channels. The desired Magnitude vs Position characteristics of the output must be specified. While the desired Magnitude vs Position characteristics may be arbitrarily chosen, it is preferable to reflect the nature of the pan-pot equations. It is essential to proper functioning of the recursive approach (but not the direct approaches) that the original pan-pot equations be preserved. The pan-pot equations are reduced along the position axis by a factor of two, and subsequently duplicated by reflection into the resulting space along the position axis, as illustrated in FIG. 27. One channel, centered between the two ("left" and "right.") inputs, may be generated by subtracting the absolute value of the (left−right) difference from the (left+right) sum. The resulting quantity is zero if one of the inputs is zero, and exhibits a maximum when the two inputs are equal and greater than zero, as depicted in FIG. 28. The quantity thus generated likely does not conform to the desired output Magnitude vs Position characteristics and must be corrected. Because the desired output Magnitude vs Position characteristics are known, a correction factor for any arbitrarily chosen position may be calculated by 1) employing the pan-pot equations to derive the relative magnitude of the left and right input signals at that position, 2) finding the sum of the derived left and right signals minus the absolute value of the difference of those signals, and 3) dividing the desired output Magnitude vs Position value at the position by the quantity obtained in step 2. These three steps are illustrated in FIG. 29. The correction factor so derived is then multiplied by the quantity originally obtained by subtracting the absolute value of the input difference from the input sum, to yield the corrected output quantity.

In practice, the position is not arbitrarily chosen; it is determined by the relative magnitudes of the left and right inputs. The correction factor is precalculated for each position where output may be desired and is stored in a look-up table. The look-up table may advantageously be calculated in one degree increments for position angles ranging from zero to ninety degrees, inclusive (extreme left to extreme right). The one degree increment size is simple and convenient, however, other increment sizes may be used.

In like manner, a look-up table containing the right/left magnitude ratios at each desired output position is precalculated by evaluating the pan-pot equations at each position and taking the right/left ratio of those evaluations. The position increments, as well as the starting and ending values, in any such precalculation must match those used in the correction factor look-up table. The resulting positional look-up table contains the right/left ratio as a function of position, but what is needed is the inverse function: Position as a function of the right/left ratio. To obtain the equivalent of the inverse function for any set of left and right inputs, the right/left ratios contained in the look-up table are examined. The position whose corresponding right/left ratio most closely matches the actual right/left input ratio is adopted as the value of the inverse function.

A positional look-up table is unnecessary if the right/left ratio corresponds to a mathematical function whose inverse is known, as is the case when the sine and cosine are employed as the pan-pot equations (sine/cosine=tangent). Although the present embodiment of the current invention assumes the pan-pot equations to be the sine and cosine and thus does not require a positional look-up table, a positional look-up table may nonetheless be employed for more generalized utility.

In addition to creating a center channel midway between the two input channels, the input channels themselves must be altered to conform to the desired output Magnitude vs Position characteristics. The right input is subtracted from the left input. If the quantity thus obtained is positive it is assigned to the left output, and if negative it is assigned to the right output after its algebraic sign is changed (thus making it positive). The left or right output so derived likely does not conform to the desired output Magnitude vs Position characteristics and must be corrected. The correction is performed in a manner analogous to that performed in correcting the center channel output; the only difference being the values contained in the correction factor look-up table. Separate correction factor look-up tables are maintained for the center output; for the left output; and for the right output. The same positional look-up table is employed to determine the position for all three correction factor look-up tables. FIG. 30 illustrates the derivation of the values contained in the left correction factor look-up table and FIG. 31 illustrates the derivation of the values contained in the right correction factor look-up table.

As described above, the core process employed in the recursive approach generates three output channels (left, center, and right) from two inputs. Because the original pan-pot equations are duplicated, albeit at half scale, the core process may be called repeatedly, employing outputs from earlier calls to generate additional output channels. FIG. 32 illustrates the output generated by repeated calls to the core process. In FIG. 32*a* the core process is called with the original input left and right signals as its two inputs. The resulting output consists of three channels: left, center, and right. In FIG. 32*b* the core process is called with said left and center outputs as its two inputs yielding left, left-center, and center outputs. The core process is called a second time with said center and right outputs as its two inputs yielding center, right-center, and right outputs. As depicted in FIG. 32*c*, this operation may be employed repeatedly to generate one channel intermediate the two channels passed to the core process as inputs.

The first direct approach derives each output channel directly from the left and right inputs, and requires more calculations per channel than the recursive approach. The first direct approach may be employed to generate output channels of arbitrary width and position, and thus is more flexible than the recursive approach. Unlike the recursive approach, the direct approaches have no effect upon adjacent channels and any necessary adjustments to said adjacent channels must be done in a separate process.

In general, four equations are employed to generate each output channel. The input signal position determines which of the four equations is to be employed. In some cases the number of equations needed may be reduced, and in some cases the equations may be simplified, but both of these possibilities are ignored in the present discussion, for generality.

The four equations are:

$$M=\text{Zero if } P<H \quad (1)$$

$$M=L+R-B1*Abs(L-C*R) \text{ if } H<=P<A \quad (2)$$

$$M=L+R-B2*Abs(L-C*R) \text{ if } A<=P<=Q \quad (3)$$

$$M=\text{Zero if } P>Q \quad (4)$$

where

M is the magnitude of the output channel

P is the position of the phantom image

Abs(XX) means that the absolute value of the quantity XX is to be taken

H is the left-most position at which the output channel may be nonZero

A is the position where the output channel maximum occurs

Q is the right-most position where the output channel may be nonZero

L is the Left input signal

R is the Right input signal

B1, B2, and C are constants to be determined.

The constants are determined as follows:

Choose the position H at which the channel rises from zero.

Choose the position A at which the channel maximum occurs.

Choose the position Q at which the channel returns to zero.

Ensure that H<A<Q.

Determine the value of the constant C:

Evaluate the pan-pot equation for L at position A.

Evaluate the pan-pot equation for R at position A.

Evaluate $C=L/R$

Determine the value of the constant B1:

Evaluate the pan-pot equation for L at position H.

Evaluate the pan-pot equation for R at position H.

Evaluate $B1=(L+R)/Abs(L-C*R)$

Determine the value of the constant B2:

Evaluate the pan-pot equation for L at position Q.

Evaluate the pan-pot equation for R at position Q.

Evaluate $B2=(L+R)/Abs(L-C*R)$

FIG. 33 illustrates the steps involved in determining the decoding constants for a hypothetical positional output channel. The four equations may be applied after the constants have been determined. Given two input signals (left and right), the position is determined from the right/left ratio and position look-up table as described for the recursive approach. If the position is less than the left position limit (H) or greater than the right position limit (Q) the output channel magnitude is set to zero. Otherwise, if the position is less than the position where the channel maximum occurs (A) equation #2 is employed to calculate the output channel magnitude, else equation #3 is employed. The resulting channel output vs position characteristics likely do not conform to the desired output Magnitude vs Position characteristics and must be corrected. The correction is accomplished as described for the recursive approach.

The second direct approach is employed in the present embodiment of the current invention for the derivation of the left and right output channels. The left and right input signals are summed and the resulting quantity is immediately multiplied by a positional correction factor without further calculation. The correction factors are precalculated at each output position of interest by dividing the desired output Magnitude vs Position characteristic for said position by the sum of the pan-pot equations evaluated at said position. No further processing is required.

The second direct approach may be generalized to generate positional channels at any lateral position in the stereo soundstage. A monophonic signal is constructed by summing the left and right inputs and then dividing that sum by the sum of the pan-pot equations evaluated at the Position as determined according to the previous discussion. The channel output is generated by multiplying the resulting monophonic signal by the desired Magnitude vs Position characteristic. Generating positional channels with the generalized second direct approach is more computationally efficient than the first direct approach and allows the location of the output channel to be changed more easily.

The current invention can be implemented in a fashion that allows the constants and correction factors used in deriving the output channels to be altered while the process is operating. This user control may prove useful to musicians attempting to study one instrument or performer in a group, because the output channels may be positioned, and narrowed, to accentuate only the object of study. Additional accentuation may be achieved by affording user control of the output channel's frequency response, to permit output to be restricted to only those frequencies emitted by the object of interest. In addition to musical study, such user controls allow existing recordings to be remixed with instruments and performers placed at locations different from those of the original recording.

Determining Output Phase

The pan-pot equations deal only with left/right relative magnitudes and do not address relative phase. The phase of the positional output channels must be determined by other means. Phase is likely not a major concern for visual displays, but is vital for the production of audio output. Phase information is contained in the Real and Imaginary parts of the Fourier Transform. The phase of a signal intended for audio output may be determined by interpolating the Real and Imaginary parts. Said interpolation is performed separately for the Real and Imaginary parts. Interpolation may be accomplished by a plurality of means, four of which will be discussed. It is important to note that the output values produced by the following three prodecures are so-called "unit vectors" and are not the values assigned to the Fourier Transforms of the output channels. The values assigned to the Fourier Transforms of the output channels are the product of the output channel's magnitude times the unit vector.

Means 1:

The position, obtained as previously described, may be employed for the basis of the interpolation. The procedure is as follows:

```
Assuming that 0<=Position<=90

Let X=Position/90

Let Y=1-X

Let LeftRealPart=inputLeftRealPart*Y

Let RightRealPart=inputRightRealPart*X

Let LeftImagPart=inputLeftImaginaryPart*Y

Let RightImagPart=inputRightImaginaryPart*X

Let tempReal=LeftRealPart+RightRealPart

Let tempimag=LeftImagPart+RightImagPart

Let tempSize=SquareRoot (tempReal*tempReal+
    tempImag*tempImag)
```

Then

```
outputRealPart=tempReal/tempSize

outputImaginaryPart=tempImag/tempSize
```

Means 2:

A linear interpolation may be based upon the left and right input magnitudes, where the input magnitude is given by

```
Magnitude=SquareRoot(RealPart*RealPart+
    ImaginaryPart*ImaginaryPart)
```

The procedure is as follows:

```
Let L=LeftInputMagnitude

Let R=RightInputMagnitude

Let M=L+R

Let X=R/M

Let Y=L/M

Let LeftRealPart=inputLeftRealPart*Y

Let RightRealPart=inputRightRealPart*X

Let LeftImagPart=inputLeftImaginaryPart*Y

Let RightImagPart=inputRightImaginaryPart*X

Let tempReal=LeftRealPart+RightRealPart

Let tempImag=LeftImagPart+RightImagPart

Let tempSize=SquareRoot(tempReal*tempReal+
    tempImag*tempImag)
```

Then

```
outputRealPart=tempReal/tempSize

outputImaginaryPart=tempImag/tempSize
```

Means 3:

A nonlinear interpolation may be performed based upon the left and right input magnitudes, where the input magnitude is given by Magnitude=SquareRoot(RealPart*RealPart+ImaginaryPart*ImaginaryPart)

In the following example the output values conform to the sine and cosine; the pan-pot equations employed in the present embodiment of the current invention.

The procedure is as follows:

Let L=LeftInputMagnitude

Let R=RightInputMagnitude

Let M=SquareRoot($L*L+R*R$)

Let $X=R/M$

Let $Y=L/M$

Let LeftRealPart=inputLeftRealPart*$Y$

Let RightRealPart=inputRightRealPart*$X$

Let LeftImagPart=inputLeftImaginaryPart*$Y$

Let RightImagPart=inputRightImaginaryPart*$X$

Let tempReal=LeftRealPart+RightRealPart

Let tempimag=LeftImagPart+RightImagPart

Let tempsize=SquareRoot(tempReal*tempReal+tempImag*tempImag)

Then outputRealPart=tempReal/tempSize outputImaginaryPart=tempImag/tempSize

Means 4:

A separate linear interpolation of the Real and Imaginary parts may be performed.

The Real parts are interpolated as follows:

Let $M$=inputLeftRealPart+inputRightRealPart

Let $X$=inputRightRealPart/$M$

Let $Y=1-X$

Let tempReal=inputLeftRealPart*$Y$+inputRightRealPart*$X$

The Imaginary parts are interpolated in an identical manner:

Let $M$=inputLeftImaginaryPart+inputRightImaginaryPart

Let $X$=inputRightImaginaryPart/$M$

Let $Y=1-X$

Let tempimaginary=inputLeftImaginaryPart*$Y$+inputRightImaginaryPart*$X$

The tempReal and tempimaginary values must be scaled so that they constitute a unit vector:

Let tempsize=SquareRoot(tempReal*tempReal+tempImaginary*tempImaginary)

Then outputRealPart=tempReal/tempSize outputImaginaryPart=tempImaginary/tempSize All four means discussed above produce acceptable audio output.

Determining the output phase of the center-rear channel is problematical. A signal appears in the center-rear channel if the left and right inputs are of nearly equal magnitude and are 180 degrees out of phase. Simplistically expressed, this means that one of the inputs is a positive quantity and the other is a negative quantity. A signal just to the right of the center-rear position has a right component that is positive, while a signal just to the left of the center-rear position has a right component that is negative. A similar situation exists for the left component. At the exact center-rear position the algebraic sign of the left and right components cannot be determined. Actual output signals have width; that is, they span a range of positions on either side of the output channel's center position. Signals in the center-rear channel undergo an abrupt change in algebraic sign as they cross the center of the channel, producing unacceptable audio output. Therefore the center-rear channel requires special processing to determine an output phase which will result in acceptable audio output across the entire width of the channel.

The center-rear output is initially computed as follows:

Let R=Real component of the Right input

Let L=Imaginary component of the Left input

Let M=SquareRoot($R*R+L*L$)

Then outputRealPart=$R/M$ outputImaginaryPart=$L/M$

The output phase so derived is not in agreement with either the right-rear or left-rear output channels. For signals originating solely from the center-rear channel this phase disagreement is of no concern, but for phantom images on either side of the center-rear channel the phase disagreement results in some spatial ambiguity; that is, the location of the phantom image is not easily discerned. The phantom image spatial definition may be improved by interpolating the center-rear phase and the phase of the other channel (right-rear or left-rear) involved in producing the phantom image. One of the four means of interpolation previously discussed may be employed, or a combination of any two of them may be employed. Linear interpolation (Means 1) may be preferred primarily due to its economy of calculation.

The center-rear phase is corrected as follows:

Assuming 0<=Position<=90

If Position=45 DO NOT INTERPOLATE

If Position<45 degrees Then

Let the Other channel be Left-Rear

Let $X$=Position/45

Let $Y=1-X$

If Position>45 degrees Then

Let Other channel be the Right-Rear

Let $Y$=Position/45−1

Let $X=1-Y$

Let realCent=CenterRearPhaseRealPart*$X$

Let realOther=OtherPhaseRealPart*$Y$

Let imagcent=CenterRearPhaseImaginaryPart*$X$

Let imagOther=OtherPhaseImaginaryPart*$Y$

Let tempReal=realCent+realOther

Let tempimag=imagcent+imagother

Let tempSize=SquareRoot(tempReal*tempReal+ tempImag*tempImag)

Then outputCenterRearRealPart=tempReal/tempSize outputCenterRearImaginaryPart=tempImag/tempSize A better estimate of the output phase of the center-rear channel may be obtained by employing linear interpolation (Means 1, Means 2, or Means 4) for the center-rear channel combined with nonlinear interpolation (Means 3) of the other (right-rear or left-rear) channel. This combination of means forces the center-rear phase to approach the phase of the other (right-rear or left-rear) channel more rapidly as the phantom image moves away from the center-rear position.

In practice, the methods described above may be advantageously implemented in two distinct fashions, by software and by hardware. When implemented in software, absent special configurations to process data in parallel fashion, the computational intensity of generating new audio outputs does not allow for real time processing and playback of files. Instead, the two channel audio data is pre-processed and stored either as a collection of separate channel and color organ outputs to be simultaneously directed to speaker and display devices, or alternatively may be remixed into a single multi-channel data file to be utilized with specially adapted channel separation devices to direct the separate channels of audio output data to the desired devices. The principal disadvantage of software implementation, as by pre-processing and storing the outputs on a personal computer, is the absence of the full range of adjustments that may be implemented when working with the original right and left outputs on a real time basis.

Figure 34:
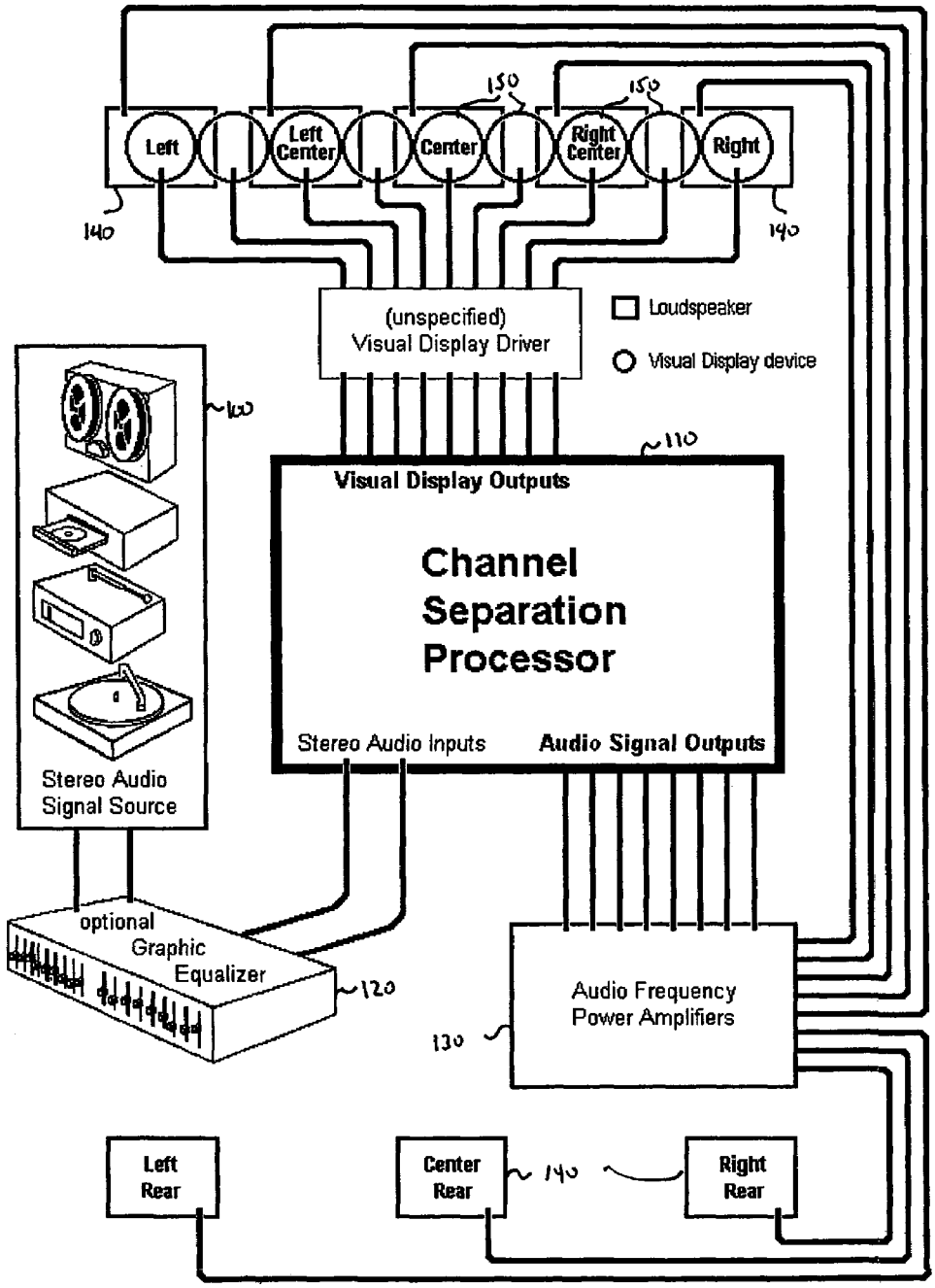
FIG. 34 illustrates a channel separation processor operating according to the present invention in a multi-channel audio and visual device system.
Figure 35:
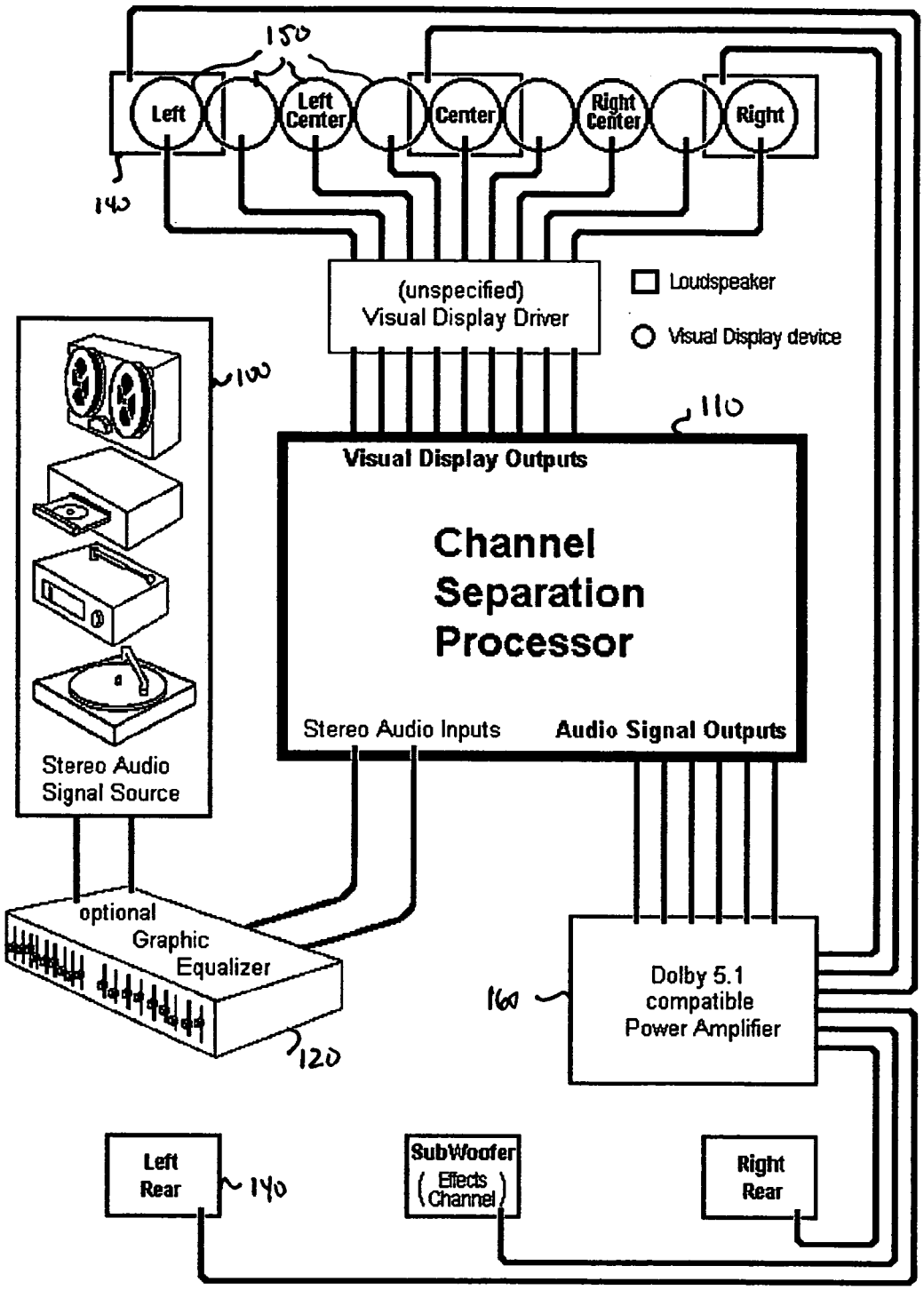
FIG. 35 illustrates the use of a channel separation processor operating according to the present invention providing channel outputs to a Dolby multi-channel audio system.

The preferred implementation is in hardware, in a fashion that will permit user controlled real time adjustments. While a hardware implementation implies the use of a special purpose device, the advantages of real time adjustments and playback capability are substantial. An exemplary channel separation configuration is shown in FIG. 34, including stereo signal source 100, channel separation device 110, graphic equalizer 120, amplifier 130, speakers 140, and optional color organs 150. The amplifier or amplifiers must have as many channels of amplification as are produced by the separation device 110. An alternative exemplary configuration utilizing a Dolby 5.1 compatible amplifier 160 is shown in FIG. 35.

Figure 36:
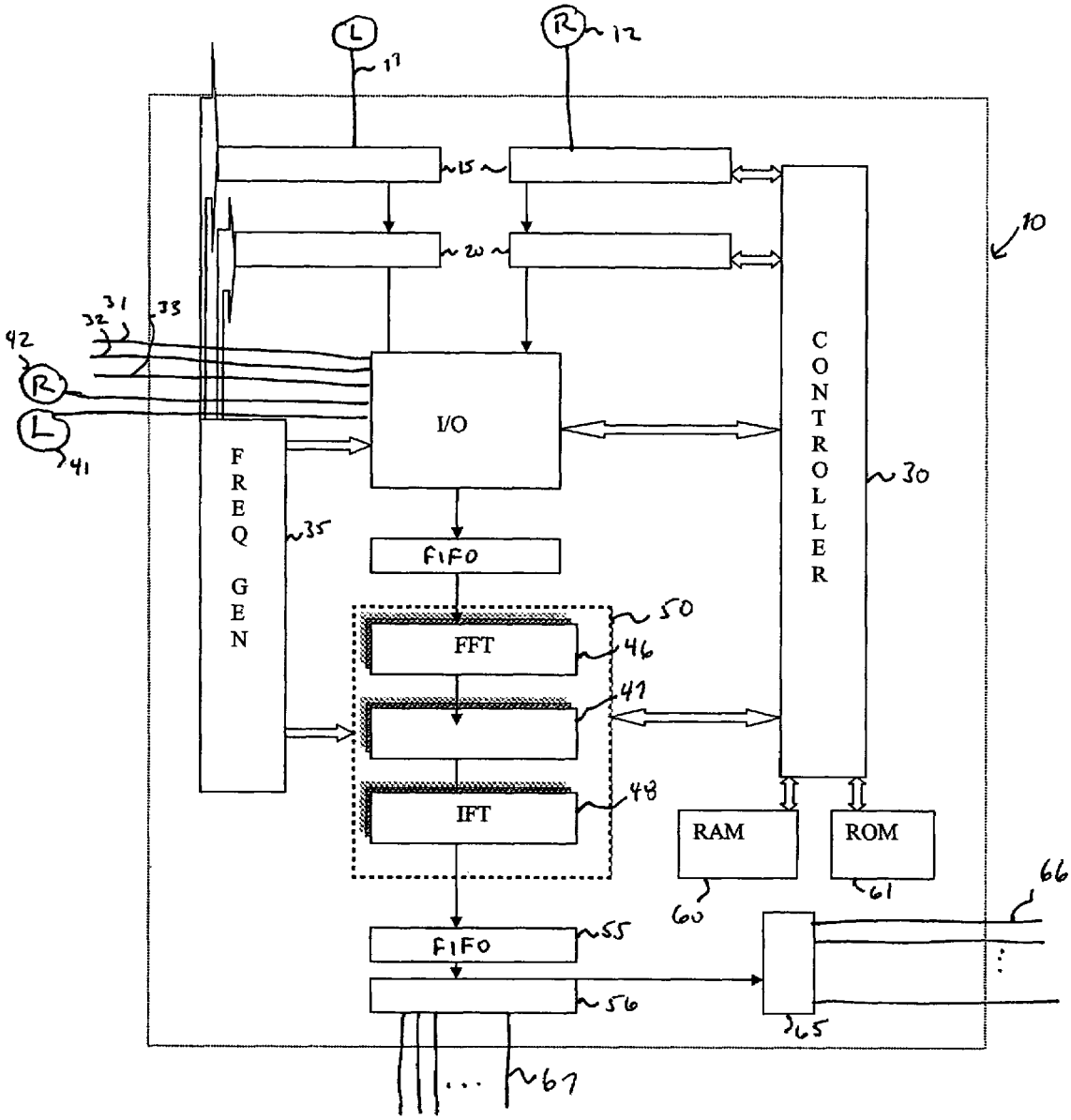
FIG. 36 is a block diagram of a channel separation device according to the present invention.

A functional block diagram of channel separation process device 10 is depicted in FIG. 36. Audio inputs may be provided in analog through left channel 11 and right channel 12. Analog inputs are processed through an analog front end 15, such as an ADC, to convert the analog signal to a digital signal. The digital signal may then be further processed and managed by interface controllers and registers 20 before proceeding to digital/I/O controller 25. Alternatively, digital left input 41 and right input 42 may proceed directly to digital I/O controller 25. The digitized stereo audio information then proceeds through FIFO registers 45 which maintain the sequential order of the audio information, then through FFT processing logic 46, audio feature processing logic 47, and IFT processing logic 48. The FFT, audio feature processing and IFT logic may be contained in separate digital signal processors or combined in a single DSP 50. It will also be understood that there may be multiple instances of FFT, audio feature processing and IFT logic to allow parallel processing of data. The previously described processors communicate with both sample frequency generator 35 and controller 30 so that processing remains under control of embedded instructions and user control input being entered through channels 31, 32, and 33. Controller 30 executes program instructions embedded in read only memory 61, which may be advantageously updated in the event of changes in audio devices.

After processing, channel and visual organ data may proceed through filters and shapers 56, and optionally if proceeding to an analog amplifier through digital to analog back end converter 65, before exiting as a plurality of at least three audio outputs 66. Color organ outputs may also be converted to analog if required before exiting as organ outputs 67.

Although preferred embodiments of the present invention have been disclosed in detail herein, it will be understood that various substitutions and modifications may be made to the disclosed embodiment described herein without departing from the scope and spirit of the present invention as recited in the appended claims.

I claim:

1. A method of creating at least three channels of audio output data from a left input channel of audio data and a right input channel of audio data comprising the steps of:

(a) converting the left input channel data from the time domain to a plurality of left frequency components in the frequency domain;

(b) converting the right input channel data from the time domain to a plurality of right frequency components in the frequency domain;

(c) establishing at least two channels for audio data output and assigning each channel a center position angle;

(d) determining the position angle of in phase phantom images in each frequency component and rounding to the nearest channel position angle;

(e) identifying out-of-phase data from the left and right frequency components;

(f) generating data for at least one forward left output channel and at least one forward right output channel;

(g) generating data for at least one additional output channel from the out-of-phase data;

(h) optimizing channel output versus position response for the data for each output channel;

(i) adjusting the output channel data magnitudes to equal the input channel magnitudes;

(j) converting the output channel data from the frequency domain to the time domain for each of the at least three channels, thereby producing audio output data for each of said channels.

2. The method of claim 1 wherein the left input channel data and the right input channel data are converted from the time domain to a plurality of left and right frequency components in the frequency domain by the Fast Fourier Transform algorithm.

3. The method of claim 1 further comprising the step of relocating signals symmetrically about the center forward output channel to create a stretched soundstage effect.

4. The method of claim 1 further comprising the step of generating color organ outputs from at least the data for the forward output channels.

5. The method of claim 1 wherein the at least three channels of audio output data comprise audio output data for a forward right channel
a forward center right channel
a forward center channel
a forward center left channel
a forward left channel
a rear right channel
a rear center channel
a rear left channel.

6. The method of claim 1 wherein interchannel gaps are inserted between the adjacent channels when optimizing channel output versus position response.

7. The method of claim 6 wherein the size of the interchannel gaps are about three positional degrees in width.

8. The method of claim 6 wherein the size of the interchannel gaps is user-adjustable.

9. The method of claim 1 wherein echo components having relative phase angles less than or equal to ninety degrees are removed from the data for the forward output channels.

10. The method of claim 9 wherein the echo components removed from the data for the forward output channels are transferred to the data for the rear output channels.

11. The method of claim 9 wherein a decay factor is utilized to decrease echo components over time.

12. The method of claim 1 wherein the at least three channels include at least a left channel, a right channel, a center forward channel and a rear channel and further comprises the steps of generating data for the center forward channel.

13. The method of claim 12 wherein the data generated for at least one additional output channel from the out-of-phase data is for the rear channel.

14. The method of claim 4 wherein a color organ output is generated for a color organ output positional channel intermediate the positions of two adjacent forward output channels.

15. The method of claim 1 further comprising the construction of a bleed signal for an output channel from the data for the adjacent output channels and applying the bleed signal to the data for the output channel.

16. The method of claim 1 wherein the channels of audio output data are compatible with a Dolby 5.1 audio playback system.

17. The method of claim 1 wherein an interpolation means algorithm is used to determine the phase of each frequency signal component.

18. A method of creating at least four channels of audio output data from a left input channel of audio data and a right input channel of audio data comprising the steps of:

(a) converting the left input channel data from the time domain to a plurality of left frequency components in the frequency domain;
(b) converting the right input channel data from the time domain to a plurality of right frequency components in the frequency domain;
(c) establishing at least three forward channels for audio data output and assigning each forward channel a center position angle;
(d) establishing at least one rear channel for audio output data;
(e) determining the position angle of in phase phantom images in each frequency component and rounding to the nearest forward channel position angle;
(f) identifying out-of-phase data from the left and right frequency components;
(g) generating data for a center forward output channel;
(h) generating data for at least one forward left output channel and at least one forward right output channel;
(i) generating data for at least one rear output channel from the out-of-phase data;
(j) optimizing channel output versus position response for the data for each output channel;
(k) adjusting the output channel data magnitudes to equal the input channel magnitudes;
(l) converting the output channel data from the frequency domain to the time domain for each of the at least four channels, thereby producing audio output data for each of said channels.

19. The method of claim 18 wherein additional processing includes a further processing step selected from the group of introducing a time delay into the data output from the rear channel, dynamic range compression for output channel data, and dynamic range expansion for output channel data.

20. A system for transforming audio data for a left input channel and a right input channel into at least four channels of audio output data comprising:

(a) converting the left input channel data from the time domain to a plurality of left frequency components in the frequency domain;
(b) converting the right input channel data from the time domain to a plurality of right frequency components in the frequency domain;
(c) establishing at least three forward channels for audio data output and assigning each forward channel a center position angle;
(d) establishing at least one rear channel for audio output data;
(e) applying an interpolation means algorithm to determine the phase of each frequency signal component;
(f) identifying out-of-phase data from the left and right frequency components;
(g) generating data for a center forward output channel;
(h) removing echo components having relative phase angles of less than or equal to ninety degrees from the data for the forward output channels and applying a delay factor to decrease echo components over time;
(i) generating data for at least one rear output channel from the out-of-phase data;
(j) optimizing channel output versus position response for the data for each output channel;
(k) adjusting the output channel data magnitudes to equal the input channel magnitudes;
(l) converting the output channel data from the frequency domain to the time domain for each of the at least four channels, thereby producing audio output data for each of said channels.

* * * * *